US007343021B2

(12) United States Patent
Takagi et al.

(10) Patent No.: US 7,343,021 B2
(45) **Date of Patent: *Mar. 11, 2008**

(54) OPTIMUM SOLUTION METHOD, HEARING AID FITTING APPARATUS UTILIZING THE OPTIMUM SOLUTION METHOD, AND SYSTEM OPTIMIZATION ADJUSTING METHOD AND APPARATUS

(75) Inventors: Hideyuki Takagi, Fukuoka (JP); Masahiro Watanabe, Tokyo (JP); Shinichi Sakamoto, Tokyo (JP)

(73) Assignee: Rion Co., Ltd., Tokyo (JP)

( * ) Notice: Subject to any disclaimer, the term of this patent is extended or adjusted under 35 U.S.C. 154(b) by 1516 days.

This patent is subject to a terminal disclaimer.

(21) Appl. No.: 09/738,388

(22) Filed: Dec. 15, 2000

(65) Prior Publication Data

US 2001/0005420 A1 Jun. 28, 2001

(30) Foreign Application Priority Data

| | | |
|---|---|---|
| Dec. 15, 1999 | (JP) | 11-356050 |
| Dec. 15, 1999 | (JP) | 11-356051 |
| Dec. 15, 1999 | (JP) | 11-356052 |
| Dec. 24, 1999 | (JP) | 11-365841 |
| Apr. 14, 2000 | (JP) | 2000-112889 |
| Apr. 14, 2000 | (JP) | 2000-112890 |

(51) Int. Cl.
*H04R 25/00* (2006.01)

(52) U.S. Cl. ..... 381/313; 381/312

(58) Field of Classification Search ..... 381/60, 381/312, 313, 314, 317, 320; 600/559
See application file for complete search history.

(56) References Cited

U.S. PATENT DOCUMENTS 6,004,015 A * 12/1999 Watanabe et al. ..... 700/28
6,674,867 B2 * 1/2004 Basseas ..... 381/314

FOREIGN PATENT DOCUMENTS

JP 9054765 * 2/1997

* cited by examiner

*Primary Examiner*—Suhan Ni
(74) *Attorney, Agent, or Firm*—Carrier, Blackman & Associates, P.C.; Joseph P. Carrier; William D. Blackman

(57) ABSTRACT

A parameter writing element converts a solution vector found by an optimum solution method that determines optimum n-dimensional solution vector, based on a plurality of optimum n-dimensional solution vector candidates to an adjustment parameter values of a programmable hearing aid and writes the adjustment parameter values into a hearing aid parameter memory element of the programmable hearing aid using a sound source memory element for storing a sound source, and a sound source presenting element for presenting the sound source to the programmable hearing aid.

11 Claims, 16 Drawing Sheets

(a)

(b)

OPTIMUM SOLUTION METHOD, HEARING AID FITTING APPARATUS UTILIZING THE OPTIMUM SOLUTION METHOD, AND SYSTEM OPTIMIZATION ADJUSTING METHOD AND APPARATUS

CROSS-REFERENCE TO RELATED APPLICATIONS

The present application claims priority under 35 U.S.C. 119, based on each of the following patents:

Japanese Patent Application No. 11-356050, filed Dec. 15, 1999;

Japanese Patent Application No. 11-356051, filed Dec. 15, 1999;

Japanese Patent Application No. 11-356052, filed Dec. 15, 1999;

Japanese Patent Application No. 11-365841, filed Dec. 15, 1999;

Japanese Patent Application No. 2000-112889, filed Apr. 14, 2000; and

Japanese Patent Application No. 2000-112890, filed Apr. 14, 2000.

BACKGROUND OF THE INVENTION

1. Field of the Invention

The present invention relates to an optimum solution method for obtaining an optimum adjustment result based on an optimum value under a plurality of conditions and a subjective evaluation by an individual, for problems that can not be adjusted based on quantitative evaluation criteria since the evaluation criteria are subjective and unclear, including adjustment of acoustic characteristics, image characteristics and the like which are suited to the preferences of the individual, and more particularly to a hearing aid fitting apparatus utilizing the optimum solution method, and a system optimization adjusting method and the apparatus thereof.

2. Description of the Relevant Art

When acoustic characteristics and image characteristics suited to the preferences of an individual are adjusted, the evaluation criteria for these characteristics are extremely subjective and unclear. Since an inclination of the preferences to each characteristic highly varies with users, there is a problem that the adjusted result cannot be evaluated and expressed quantitatively.

In addition, since there is usually a plurality of parameters for adjusting the acoustic characteristics and the image characteristics to be targeted, and an interaction between these parameter values has a strong influence on the user's subjective evaluation, it is further difficult to determine the optimum adjustment result.

To solve these problems, an optimization adjusting method utilizing an interactive genetic algorithm is proposed, for example, in Japanese Unexamined Patent Publication No. Hei 9-54765. According to this method, an n-dimensional vector of which the element is n-units of adjustment parameters is a solution vector (a chromosome), wherein an acoustic signal or a picture signal that is processed according to each solution vector is presented to the user. The genetic algorithm is then performed based on the evaluation value assigned by the user to each solution vector to estimate an optimum solution vector.

According to this method, a characteristic that the user himself subjectively feels to be most comfortable can be computed, not by separately computing the optimum value for each adjustment value, but by taking the interaction between each adjustment value into consideration.

In a conventional interactive genetic algorithm, a method called the elite strategy is often used. In the genetic algorithm, children (solution vectors of the next generation) who are born by crossing their parents (solution vectors) whose evaluation values have been high do not always have evaluation values as high as their parents. There is a problem that the parents who have existed in the preceding generation have higher evaluation values than their children, but the solution vector of the parents can not be reproduced in the following generation and it is also difficult to converge on an optimum solution.

The elite strategy is a method, to avoid such a phenomenon, that leaves an a-units of parents with higher evaluation values to the next generation as is.

Also, another method for determining an optimum image on a certain problem is suggested (SIGGRAPH Conf. Proc., Vol. 1997, pp 389–400, 1997). This is a system that forms an n-dimensional solution vector (n>2) of which the component is a characteristic adjustment value of an image to be targeted. Each solution vector is mapped onto a two-dimensional space for illustration to the user. When the user designates any coordinate within the two-dimensional space, an image, of which the adjustment value is a solution vector corresponding to the coordinate, is presented to that user. According to this method, each solution vector is mapped onto the two-dimensional space utilizing MDS (Multidimensional Scaling) and the like based, on a Euclidean distance between each vector, and an optimum value can be determined, while allowing the user to image the distance in the multidimensional space, in the two-dimensional space.

A hearing aid fitting operation is considered to be one example of problems that determine the acoustic characteristic, the image characteristic, and the like that are suited to the preferences of an individual, which is a subject of the present invention. Hearing characteristics of a hearing impaired person vary with individuals and their preferences for a sound also differ. Most hearing aids are provided with a plurality of adjustment functions (for example, volume control, frequency response control, output limit control, automatic gain control, etc.) to suit different types of hearing impaired persons.

Hearing aid fittings are operations for setting the degree of adjustment (adjustment value) for each adjustment function at a value optimum for each hearing impaired person. The fitting operation is usually conducted by substituting a value of an audiogram and the like in a known fitting formula. On the other hand, Japanese Unexamined Patent Publication No. Hei 9-54765 proposes a method for performing the hearing aid fitting operation using the interactive genetic algorithm in which the n-dimensional solution vector is composed by using the adjustment value of each adjustment function.

However, in the interactive genetic algorithm, there is a problem that a single optimum value is determined on a single condition for a certain problem and as a result, the optimum value specific for that condition, i.e. for the condition used in the adjustment, has been determined. Accordingly, in a problem in which there is a plurality of conditions, the interactive genetic algorithm must be conducted on each condition and the optimum value specific for each condition must be determined, wherein the final single optimum value must be separately determined. This final optimum value has been determined by the operator's subjective evaluation, or the formula and the like, that are prepared irrespective of each user's preferences.

For example, in the hearing aid fitting operation, when any single sound source (for example, a speech signal) is used for performing the interactive genetic algorithm, there is a problem that the optimum value specific for that sound source has been determined.

The hearing aid is an apparatus that is used under various environments. The hearing impaired persons must be provided with comfortable hearing conditions under any environments. Accordingly, it is necessary to perform the interactive genetic algorithm on a plurality of conditions (for example, a plurality of environmental sounds), not on a single sound source, in which an optimum value must be collected from each operation of the genetic algorithm before determining the final optimum value.

However, there is still a problem that this final optimum value must be determined by the operator's subjective evaluation, or the formula and the like, that are prepared irrespective of each user's preferences.

In the method in which the multidimensional solution vector is mapped onto the two-dimensional space so that the user can determine the optimum value, if the dimension number of the solution vector and/or the number of bits of the components (a gene) of the solution vector are large, the number of optimum solution vector candidates to be illustrated in the two-dimensional space becomes large. Thus, it takes a long time to determine the optimum value and there is a problem that a burden imposed on the user also increases.

For example, in the hearing aid fitting operation, when the multidimensional solution vector is mapped onto the two-dimensional space so that the user can determine the optimum value, the number of optimum solution vector candidates illustrated to the hearing impaired person becomes enormous, depending upon the number of adjustment functions of the hearing aid and/or the number of bits of the adjustment value of each adjustment function. Thus, there is a problem that the time required for fitting is very long and the burden imposed on the hearing-impaired person also increases.

In the interactive genetic algorithm, there is a problem that it is difficult for the user to judge the criteria for the evaluation value. The judgment criteria of a human being are vague, and when the solution vector that has received a higher evaluation is reproduced in the next generation, the user does not always evaluate it higher.

Many users cannot remember acoustic characteristics of the solution vector generated until then. Even though the same or extremely similar solution vectors are reproduced in the next generation, it is difficult for the user to realize that these are the vectors that have appeared before and as a result, there is a problem that the user has evaluated differently from the last time. This indicates that the user's evaluation criteria change whenever the generation of the genetic algorithm is altered.

In the interactive genetic algorithm, the optimum value is sought based on the user's evaluation. Fluctuations in such an evaluation exert a great influence on convergent speed and accuracy of the optimum value.

Even though the elite strategy is employed, it is very difficult to identify the elite in the preceding generation from among a plurality of solution vectors in the new generation. It has been impossible to reduce these fluctuations in evaluation.

For example, in the case of the hearing aid fitting operation, when the solution vector (fitting value) on which the hearing impaired user has set a high evaluation is presented to him again, he does not always set a higher evaluation on it. Accordingly, there is still a problem that the user sets a different evaluation value on the same vector than before whenever the generation of the genetic algorithm is altered.

Even though the elite strategy is applied, it is very hard for the user to locate the elite. Therefore, there is a problem that the elite does not serve as judgment criteria and the judgment criteria have also changed when the generation is altered.

SUMMARY OF THE INVENTION

The primary object of the present invention is to overcome the above-mentioned problems and to provide an optimum solution method for a problem that determines one optimum n-dimensional solution vector based on the optimum n-dimensional solution vector candidates corresponding to a plurality of conditions. In this embodiment of the invention, the method comprises, a first step of illustrating positions of a plurality of optimum n-dimensional solution vector candidates in a two-dimensional space, a second step of selecting an optional coordinate in the two-dimensional space, a third step of computing an n-dimensional solution vector corresponding to the optional coordinate selected based on the coordinates of the plurality of n-dimensional solution vector candidates in the two-dimensional space, characterized in that an optimum n-dimensional solution vector is determined based on the plurality of optimum n-dimensional solution vector candidates.

Another object of the present invention is to provide an optimum solution method for a problem that allows a user to determine one optimum n-dimensional solution vector based on the optimum n-dimensional solution vector candidates corresponding to a plurality of conditions. In this embodiment of the invention, the method comprises, a first step of illustrating positions of a plurality of optimum n-dimensional solution vector candidates in a two-dimensional space, a second step of allowing a user to select an optional coordinate in the two-dimensional space, a third step of computing the n-dimensional solution vector corresponding to the optional coordinate that the user has selected, based on the coordinates of the plurality of n-dimensional solution vector candidates in the two-dimensional space and an evaluation value by the user of the plurality of n-dimensional solution vectors which has been acquired in advance, characterized in that the user can determine an optimum n-dimensional solution vector, based on the plurality of optimum n-dimensional solution vector candidates.

With these methods, it is possible to efficiently and correctly find a single optimum value in view of a plurality of conditions, upon including the preferences of the user, that is not the optimum value specific to a specified condition, for a problem for which the evaluation criteria are subjective and unclear.

Also, if the plurality of optimum n-dimensional solution vector candidates or the evaluation by the user of the plurality of n-dimensional solution vectors is determined by the interactive genetic algorithm, it is possible to efficiently and correctly acquire the optimum value for the plurality of conditions and the evaluation value for the plurality of solution vectors. It is therefore possible to find the single optimum value in view of the plurality of conditions, efficiently and correctly.

When the n-dimensional solution vector comprises adjustment parameters of the hearing aid, it is possible to perform a hearing aid fitting operation that includes the preferences of each hearing impaired user for a sound.

When the n-dimensional solution vector comprises adjustment parameters of an image, it is possible to acquire an optimum, single image adjustment value upon including the preferences of each user for the image.

When the plurality of optimum n-dimensional solution vector candidates is the optimum n-dimensional solution vector for a plurality of sound sources, it is possible to perform a fitting operation suitable for various sound environments, not the fitting operation specific to the specified sound environments, by using the presented sound sources as a plurality of environmental sounds.

A further object of the present invention is to provide a hearing aid fitting apparatus which comprises parameter writing means for converting an n-dimensional solution vector found by the optimum solution method to adjustment parameter values of a hearing aid and for writing the parameters value into a hearing aid parameter memory element of the hearing aid, sound source memory means for storing sound sources, and sound source presenting means for presenting the sound source to the hearing aid.

With this construction, it is possible to perform a hearing aid fitting operation that includes the preferences of each hearing impaired user for a sound and is suitable for various sound environments.

A further object of the present invention is to provide a hearing aid fitting apparatus which comprises parameter writing means for converting an n-dimensional solution vector found by the optimum solution method to adjustment parameter values of a hearing aid and for writing the adjustment parameter values into a hearing aid parameter memory element of the hearing aid, sound source memory means for storing sound sources, sound source presenting means for presenting the sound source to the hearing aid, and display means for displaying the adjustment parameter values of the hearing aid and/or a visual diagram based on acoustic information expressed by the n-dimensional solution vector.

With this construction, it is possible to perform a hearing aid fitting operation that includes the preferences of the hearing impaired user for the sound and is suitable for various sound environments, referring to the adjustment parameter value of the hearing aid and/or the visual diagram based on the acoustic information which are displayed by the display means.

Further, if the n-dimensional solution vector corresponding to optional coordinates which the user has selected is converted to the adjustment parameter values of the hearing aid, the parameter values are then written into the hearing aid parameter memory element of the hearing aid, and the plurality of sound sources are presented to the user in sequence, it is possible to determine the optimum fitting value while confirming the hearing aid effect of the fitting value that each hearing impaired user has selected the parameter values by himself, in various sound environments.

A further object of the present invention is to provide a system optimization adjusting method utilizing an interactive genetic algorithm, in which when a new solution vector set is generated by performing arithmetic recombination operations based on genetic recombination of a solution vector in a solution vector set, based on fitness value of each solution vector, a predetermined number of solution vectors for which the fitness value is high in the solution vector set of the preceding generation is included in the new solution vector set, characterized in that the solution vectors for which the fitness value is high is clearly expressed.

Another object of the present invention is to provide a system optimization adjusting apparatus utilizing an interactive genetic algorithm, which comprises a solution vector set generating element for generating a new solution vector set by performing arithmetic recombination operations based on genetic recombination of a solution vector in a solution vector set, based on fitness value of each solution vector, the solution vector set generating element having a function of including a predetermined number of solution vectors, for which the fitness value is high in the solution vector set of the preceding generation, in the new solution vector set, characterized in that a solution vector expressing element for clearly expressing the solution vector for which the fitness value is high is provided.

With this method and apparatus, when the system optimization adjusting method utilizing the interactive genetic algorithm is conducted for a problem for which the evaluation criteria are subjective and unclear, it is possible for each user to evaluate the problem while confirming the evaluation criteria and to find the optimum solution efficiently and correctly by minimizing the fluctuations in the evaluation.

Further, if the solution vector for which the fitness value is high is specified in a color different from other solution vectors, an elite individual in the interactive genetic algorithm is specified in a different color. It is therefore possible for each user to evaluate the solution vector while confirming the evaluation criteria and to find the optimum solution efficiently and correctly by minimizing the fluctuations in the evaluation.

When the solution vector for which the fitness value is high is specified in a different brightness from other solution vectors, an elite individual in the interactive genetic algorithm is specified in a different brightness. It is therefore possible for the user to evaluate the solution vector while confirming the evaluation criteria and to find the optimum solution efficiently and correctly by minimizing the fluctuations in the evaluation.

When the solution vector for which the fitness value is high is specified in a shape different from other solution vectors, an elite individual in the interactive genetic algorithm is specified in a different shape. It is therefore possible for each user to evaluate the solution vector while confirming the evaluation criteria, and to find the optimum solution efficiently and correctly by minimizing the fluctuations in the evaluation.

A further object of the present invention is to provide a system optimization adjusting method utilizing an interactive genetic algorithm of which the subject is acoustic information, characterized in that when acoustic information expressed by each solution vector is presented to the user, a visual diagram is provided based on the acoustic information expressed by each solution vector.

A still further object of the present invention is to provide a system optimization adjusting apparatus utilizing an interactive genetic algorithm of which the subject is acoustic information, which comprises an acoustic information presenting element for presenting the acoustic information expressed by each solution vector to a user, and a visual diagram presenting element for providing a visual diagram based on the acoustic information expressed by the solution vector.

With this method and apparatus, by providing the visual diagram based on the acoustic information expressed by each solution vector, when the user evaluates each solution vector, he can easily remember the value which he has determined for the past solution vectors. It is therefore possible to find the optimum solution efficiently and correctly by minimizing the fluctuations in the evaluation.

Also, if the visual diagram shows frequency response curves of the acoustic information, since the frequency response curves of the acoustic information are provided as a visual diagram, the user can easily remember the evaluation he has made of past solution vectors. It is therefore possible to find the optimum solution efficiently and correctly by minimizing the fluctuations in the evaluation.

If the visual diagram shows input/output functions of the acoustic information, since the input/output functions of the acoustic information are provided as a visual diagram, the user can easily remember the evaluation he has made of past solution vectors. It is therefore possible to find the optimum solution efficiently and correctly by minimizing the fluctuations in the evaluation.

If the visual diagram is a waveform of the acoustic information, since the waveform of the acoustic information is provided as a visual diagram, the user can easily remember the evaluation he has made of past solution vectors. It is therefore possible to find the optimum solution efficiently and correctly by minimizing the fluctuations in the evaluation.

If the visual diagram is a sound spectrogram of the acoustic information, since the sound spectrogram of the acoustic information is provided as a visual diagram, the user can easily remember the evaluation he has made of past solution vectors. It is therefore possible to find the optimum solution efficiently and correctly by minimizing the fluctuations in the evaluation.

BRIEF DESCRIPTION OF THE DRAWINGS

The above and other objects, features and advantages of the present invention will become more apparent from the following description when taken in conjunction with the accompanying drawings.

DETAILED DESCRIPTION OF THE PREFERRED EMBODIMENTS

Preferred embodiments of the present invention will now be described with reference to the accompanying drawings.

Figure 1:
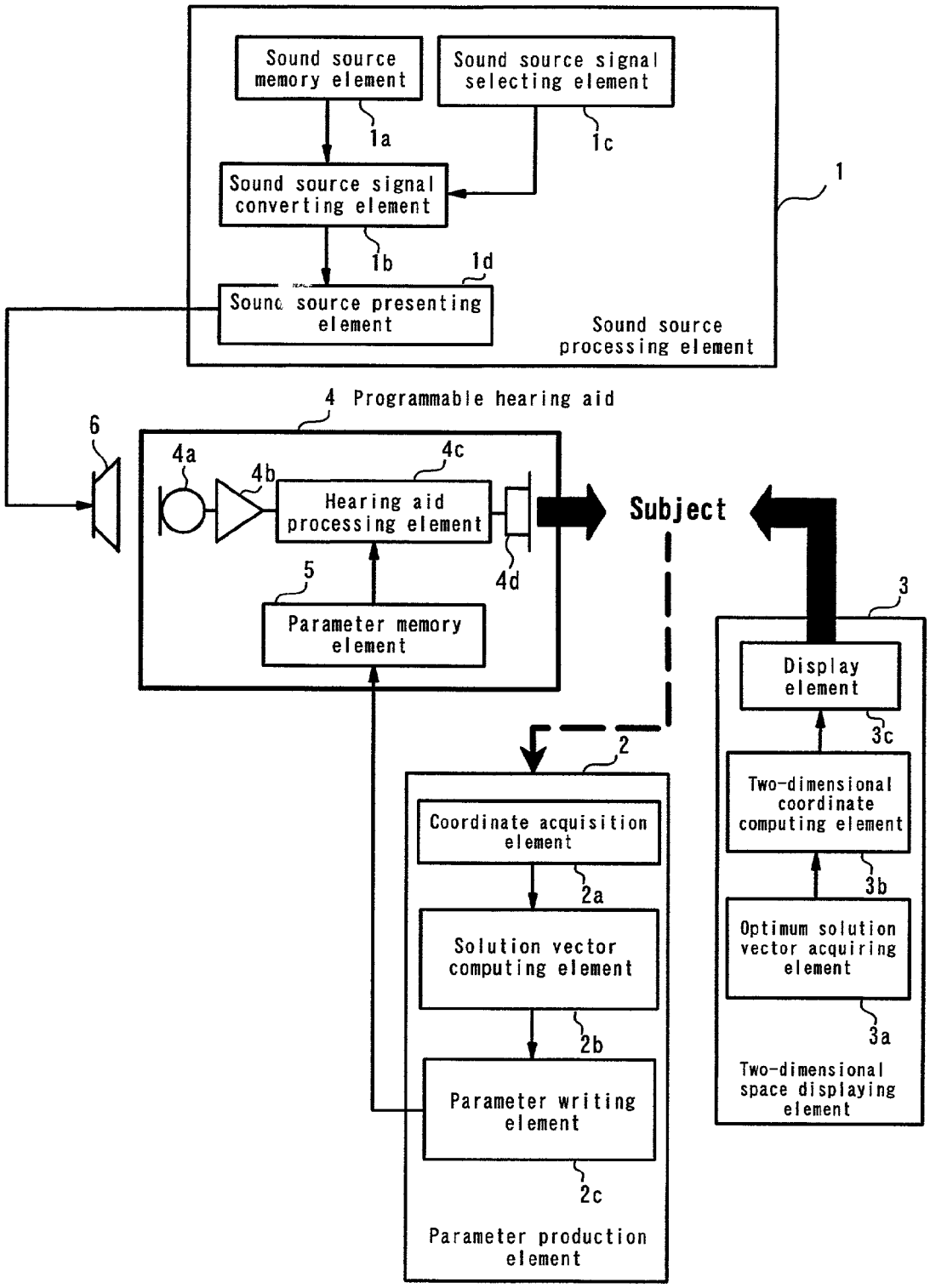
FIG. 1 is a schematic diagram of a hearing aid fitting apparatus according to a first embodiment of the present invention.

A hearing aid fitting apparatus according to a first embodiment of the present invention comprises, as shown in FIG. 1, a sound source processing element 1, a parameter production element 2, and a two-dimensional space displaying element 3. Reference numeral 4 is a so-called programmable hearing aid, and reference numeral 6 is a speaker for presenting a speech sound, an environmental sound, and the like, to the programmable hearing aid 4.

The sound source processing element 1 consists of a sound source memory element 1*a*, a sound source signal converting element 1*b*, a sound source signal selecting element 1*c*, and a sound source presenting element 1*d*. The parameter production element 2 consists of a coordinate acquisition element 2*a*, a solution vector computing element 2*b*, and a parameter writing element 2*c*. The two-dimensional space displaying element 3 consists of an optimum solution vector acquiring element 3*a*, a two-dimensional coordinate computing element 3*b*, and a display element 3*c*.

The programmable hearing aid 4 consists of a microphone 4*a*, an amplifier 4*b*, a hearing aid processing element 4*c*, an earphone 4*d*, and a parameter memory element 5, wherein the parameter writing element 2*c* is connected to the parameter memory element 5 of the programmable hearing aid 4.

The sound source memory element 1*a* stores a plurality of environmental sound files on which the environmental sounds used in a fitting operation are digitally recorded and a calibration sound file. The environmental sound and calibration sound files are composed of, for example, digital data in a WAVE file format.

The sound source converting element 1*b* has a function of accessing the environmental sound file which is stored in the sound source memory element 1*a*, based on a control signal from the sound source signal selecting element 1*c*. The sound source signal converting element 1*b* also has a function of converting the digital data stored in the environmental sound file to an analog environmental sound signal.

The sound source presenting element 1*d* amplifies or attenuates a sound source signal (an analog signal) output from the sound source signal converting element 1*b* at a predetermined level. The sound source presenting element 1*d* then presents the amplified or attenuated sound source signal to the programmable hearing aid 4 using a speaker 6 and the like.

The coordinate acquisition element 2*a* acquires an optional two-dimensional coordinate that a user has selected within the two-dimensional space displayed at the display element 3*c*. The solution vector computing element 2*b* computes an n-dimensional solution vector composed of adjustment values for each adjustment function of the hearing aid, from the two-dimensional coordinate which the coordinate acquisition element 2*a* has acquired.

The parameter writing element 2*c* has a function of writing the solution vector computed at the solution vector computing element 2*b* into the parameter memory element 5 of the programmable hearing aid 4 as parameters of the adjustment functions of the programmable hearing aid 4.

The optimum solution vector acquiring element 3*a* acquires a predetermined optimum fitting value, i.e. an optimum solution vector, of the user to each environmental sound.

The two-dimensional coordinate computing element 3*b* computes coordinates of the two-dimensional space to be illustrated to the user, from the solution vector that the optimum solution vector acquiring element 3*a* has acquired.

The display element 3*c* can illustrate the two-dimensional space to the user based on the coordinates of the two-dimensional space that the two-dimensional coordinate computing element 3*b* has computed. The display element 3*c* can also display adjustment parameter values (for example, an acoustic gain: GAIN, an output limit: MOP, and a break point for input/output functions: TK and the like) of the programmable hearing aid 4 and an acoustic information (frequency response diagram, input/output function diagram, time waveform diagram, and sound spectrogram), based on the coordinates of the two-dimensional space that the two-dimensional coordinate computing element 3*b* has computed.

The sound source memory element 1*a*, the sound source signal converting element 1*b*, and the sound source signal selecting element 1*c* forming the sound source processing element 1, the coordinate acquisition element 2*a* and the solution vector computing element 2*b* forming the parameter production element 2, and the optimum solution vector acquiring element 3*a*, the two-dimensional coordinate computing element 3*b* and the display element 3*c* forming the two-dimensional space displaying element 3 can be provided by a personal computer.

Namely, a self-contained hard disk and/or a memory of the personal computer assume the function of the sound source memory element 1*a*. A CPU and a predetermined program assume functions of the sound source signal converting element 1*b*, the sound source signal selecting element 1*c*, the solution vector computing element 2*b*, and the two-dimensional coordinate computing element 3*b*. A keyboard and/or a mouse assume functions of the coordinate acquisition element 2*a*, the optimum solution vector acquiring element 3*a*, and a display assumes the function of the display element 3*c*.

Figure 2:
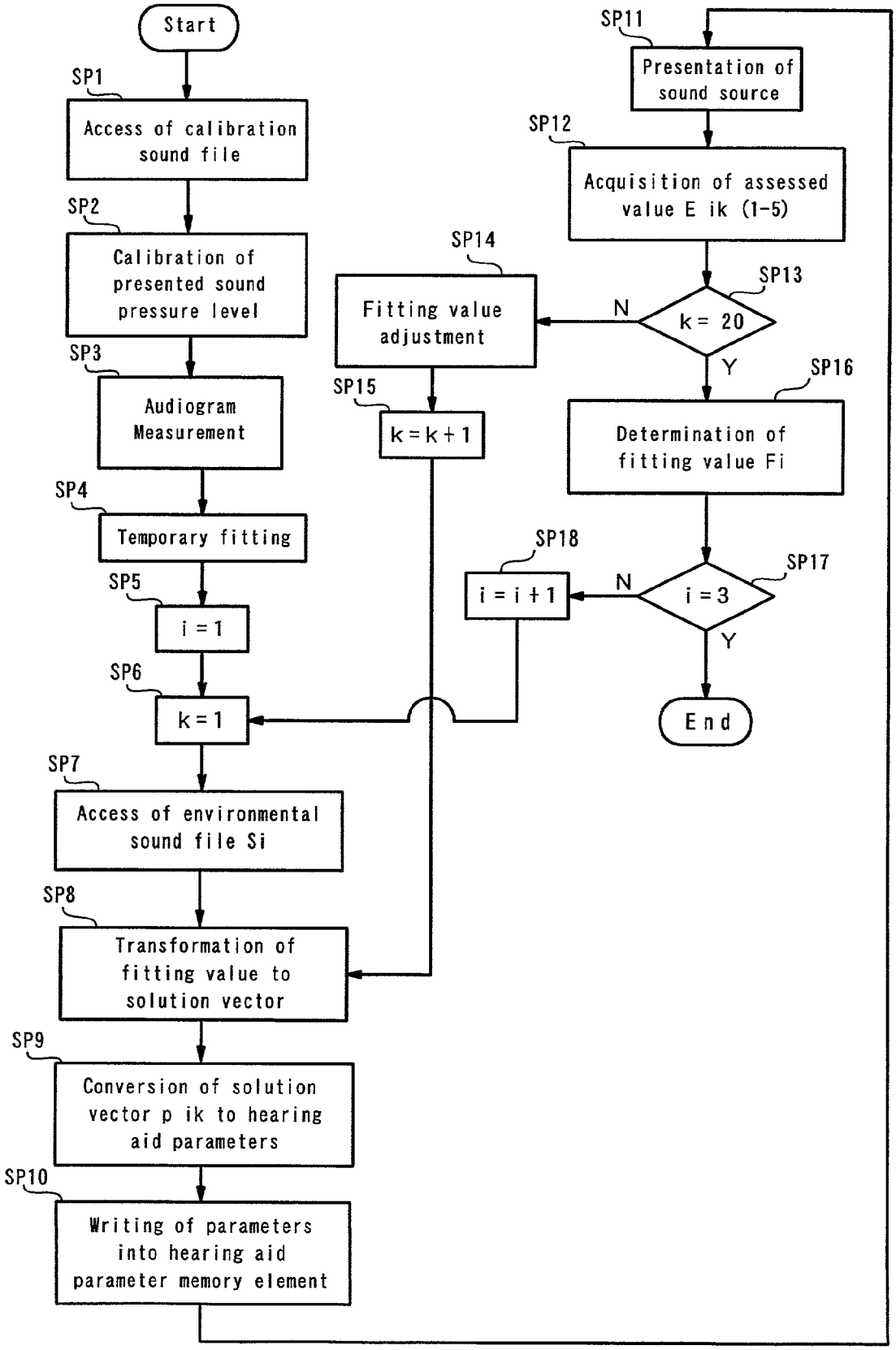
FIG. 2 is a flow chart for acquiring an optimum value for three environmental sounds and evaluation values of a plurality of solution vectors in advance.
Figure 3:
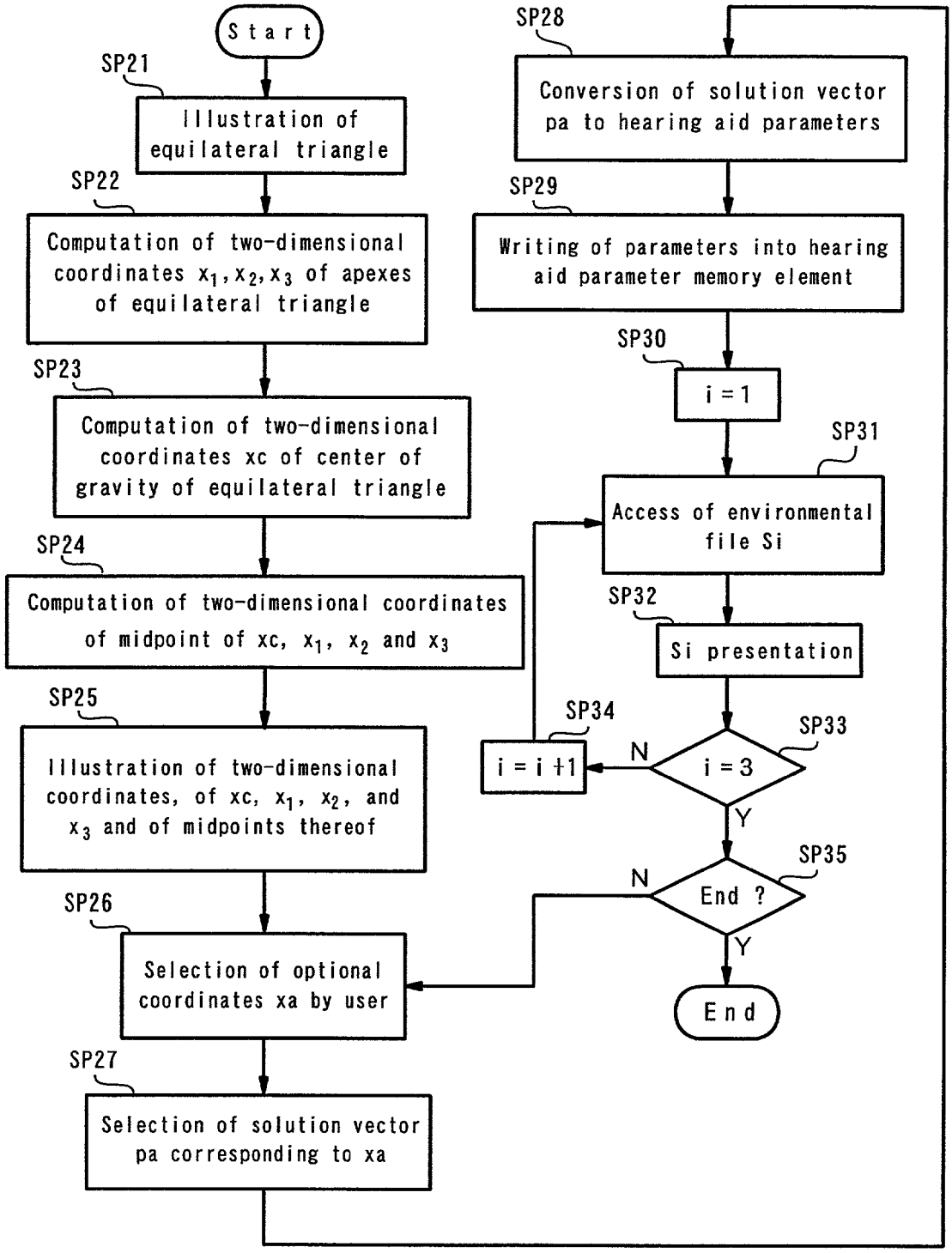
FIG. 3 is a flow chart for determining a single final optimum fitting value based on a result available from a method shown in FIG. 2.

An operation of the hearing aid fitting apparatus as constructed above according to the first embodiment of the present embodiment will now be explained hereunder with reference to flow charts as shown in FIGS. 2 and 3.

In FIG. 2, first, in step SP 1, prior to the fitting operation, the sound source signal selecting element 1*c* is operated to access a calibration sound file from the sound source memory element 1*a* for presented sound pressure level calibration when the sound source is presented. The calibration sound file is then presented from the sound source presenting element 1*d*.

In step SP 2, the presented sound pressure level calibration is performed using a sound level meter and the like by controlling the degree of amplification or attenuation of the sound source presenting element 1*d*.

Next, in step SP 3, an audiogram of a hearing impaired person is measured. In step SP 4, a temporary fitting value is computed using the measured audiogram in a known hearing aid fitting formula.

In steps SP 5 and SP 6, initialization (i=1, k=1) is performed. In step SP 7, an environmental sound file is accessed. For example, the information about "an environment where a hearing aid is most frequently used" is obtained from a subject in advance, and the environmental sound file that is considered to be closest to such an environment is used here.

According to the embodiments of the present invention, the environmental sound is classified into three types, a domestic noise $S_1$, an office noise $S_2$, and a factory noise $S_3$.

Next, in step SP 8, fitting values composed of the adjustment values of each adjustment function of the programmable hearing aid 4 are transformed to a solution vector. Here, a solution vector set is expressed by $p_{ik}$ (i=1,2,3. . . , m, k=1,2,3. . . , n), and in the embodiment according to the present invention, m=3, N=20.

In step SP 9, the solution vector $p_{ik}$ designated at the parameter writing element 2*c* is converted to parameters of the programmable hearing aid 4. In step SP 10, the parameters are then written into the parameter memory element 5 of the programmable hearing aid 4.

Next, in step SP 11, the environmental sound file accessed earlier is reproduced at the sound source signal converting element 1*b* and the sound source presenting element 1*d* and presented to the programmable hearing aid 4 from the speaker 6. The subject listens to an output sound (i.e. the environmental sound that has been hearing aid-processed according to the solution vector $p_{ik}$) of the programmable hearing aid 4.

In step SP 12, a value $E_{ik}$ from an evaluation by the subject of the presented sound, i.e. the solution vector $p_{ik}$ at that time, is obtained. The value $E_{ik}$ is a numerical value expressing the subject's subjective evaluation, based on comfort, intelligibility, and the like, for the presented sound. The value $E_{ik}$ is classified into five grades from 1 to 5, wherein the value 1 expresses the lowest evaluation, while the value 5 expresses the highest evaluation in this embodiment, respectively.

In step SP 13, a judgment is made as to whether or not all values up to $E_{i20}$ have been acquired. If not acquired, the program goes to step SP 14, wherein the above-mentioned operations are repeated. In step SP 14, the subjective evaluation of the subject for the current fitting value is obtained and then, the fitting value is adjusted or altered taking the content obtained from the subject and the value $E_{ik}$ into consideration.

This adjustment or alteration is conducted to such an extent that if the evaluation is, for example, "noisy", the value of the volume control or output limit is reduced.

On the other hand, when all values up to $E_{i20}$ have been acquired, in step SP 16, the solution vector $p_{ik}$ that has received the highest value until then is determined to be the optimum fitting value $F_i$ for the environmental sound.

Next, in step SP 17, a judgment is made as to whether or not the above-mentioned operation has been performed up to the factory noise $S_3$. When the operation has been performed up to the factory noise $S_3$, the fitting operation is completed. If not performed, the program goes to step SP 18, wherein the above operation is repeated until the fitting operation is completed for the factory noise $S_3$.

A method for determining the final fitting value is shown by a flow chart of FIG. 3, using the optimum fitting values $F_1$, $F_2$, and $F_3$, for the 3 types of sound sources $S_1$, $S_2$, and $S_3$ which are found by the flow chart as shown in FIG. 2.

First, in step SP 21, an optional equilateral triangle is illustrated on a screen of the display element 3*c*. In step SP 22, two-dimensional coordinates $x_1$, $x_2$, and $x_3$ of the three apexes of the triangle are computed by the two-dimensional coordinate computing element 3*b*. The equilateral triangle in this case may be formed of such a size that the user can easily operate. The coordinates $x_1$, $x_2$, and $x_3$ respectively correspond to the values $F_1$, $F_2$, and $F_3$.

Next, in step SP 23, a two-dimensional coordinate $x_c$ of the center of gravity of the equilateral triangle is computed by the two-dimensional coordinate computing element 3*b*. In step SP 24, two-dimensional coordinates $x_{12}$, $x_{13}$, $x_{1c}$, $x_{23}$, $x_{2c}$, and $x_{3c}$ of each midpoint of two-dimensional coordinates $x_1$, $x_2$, and $x_3$ of the three apexes and the two-dimensional coordinate $x_c$ of the center of gravity are computed by the two-dimensional coordinate computing element 3*b*.

In step SP 25, positions of the two-dimensional coordinates $x_1$, $x_2$, and $x_3$ of the three apexes, the two-dimensional coordinate $x_c$ of the center of gravity, and the coordinates of the midpoints $x_{12}$, $x_{13}$, $x_{1\ c}$, $x_{23}$, $x_{2c}$, and $x_{3c}$ are illustrated on the screen by the display element 3*c*.

Figure 4:
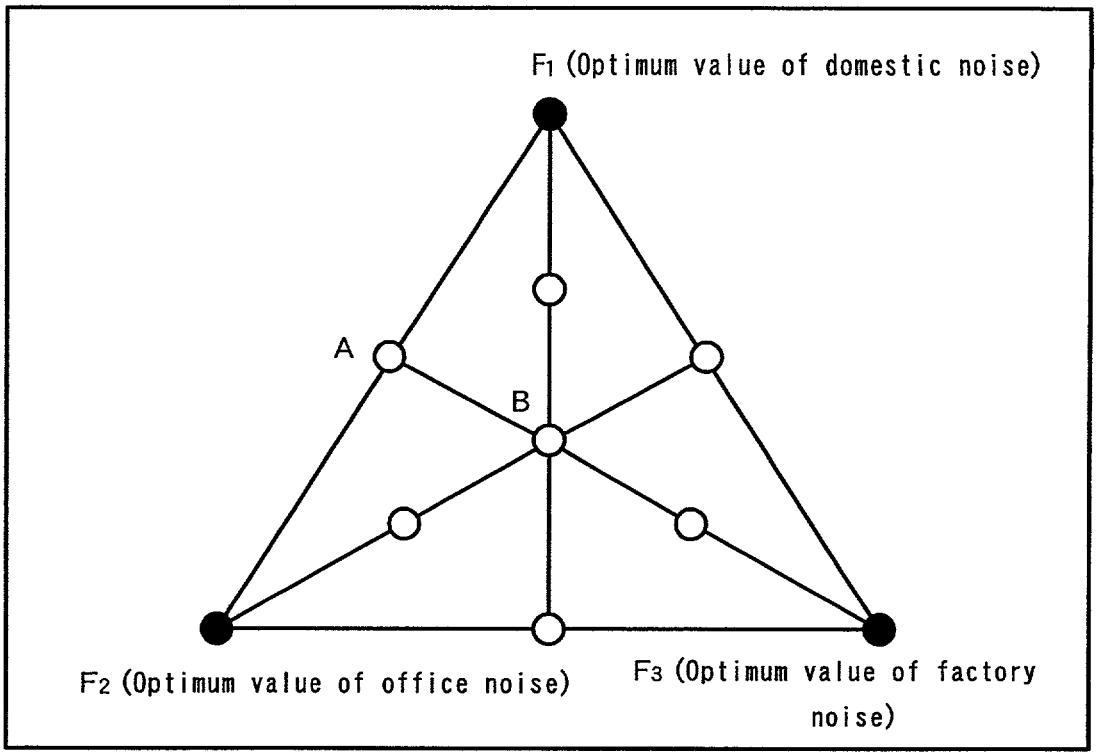
FIG. 4 is a view showing one example of a two-dimensional space used in a method as shown in FIG. 3.

FIG. 4 shows one example of the two-dimensional space illustrated on the screen.

Next, in step SP 26, the user indicates an optional position in the two-dimensional space, referring to the positions of the three apexes, in the two-dimensional space as shown in FIG. 4.

Thus, the coordinate acquisition element 2*a* acquires the coordinate $x_a$ of the indicated position in the two-dimensional space. For example, when the user's workplace is an office and he mainly uses the hearing aid in the workplace and at home after he returns, the user may indicate the position such as a point A as shown in FIG. 4.

In step SP 27, the solution vector $p_a$ corresponding to $x_a$ is computed in the solution vector computing element 2*b*. If the solution vector $p_a$ is, for example, $x_a=x_c$, it is considered as a mean solution vector $F_c$ of which the component is a mean value of each component of the solution vectors $F_1$, $F_2$, and $F_3$, i.e., the optimum fitting values for the three types of sound sources $S_1$, $S_2$, and $S_3$. If $x_a=x_{3c}$, the solution vector $p_a$ is considered as a mean solution vector $F_{3c}$ of which the component is a mean value of each component of $F_3$ and $F_c$.

In step SP 28, the solution vector $p_a$ is converted to parameters of the programmable hearing aid 4 by the parameter writing element $\mathbf{2}_c$ and in step SP 29, the parameters are written into the parameter memory element 5 of the programmable hearing aid 4.

Next, in steps SP 30 to SP 32, a file of the environmental sound (domestic noise $S_1$) corresponding to the solution vector $F_1$ is reproduced at the sound source signal converting element 1*b* and the sound source presenting element 1*d*. The file is then presented to the programmable hearing aid 4 from the speaker 6. The subject listens to the output sound (i.e. the domestic noise $S_1$ which is hearing aid-processed according to the solution vector $P_a$) of the programmable hearing aid 4.

After the subject listens to the output sounds of the programmable hearing aid 4 for each of the three types of environmental sounds $S_1$, $S_2$, and $S_3$, in step SP 35, if the subject is satisfied with the current fitting value $p_a$, the fitting operation is completed. If not satisfied, the program goes back to step SP 26, wherein the above-mentioned operations are repeatedly performed.

With the current fitting value $p_a$, the user feels it easier to hear both under domestic noise and office noise, but if he wants to hear a bit more comfortably, even under factory noise, an optional coordinate $x_a$ should be located at a point B.

Figure 5:
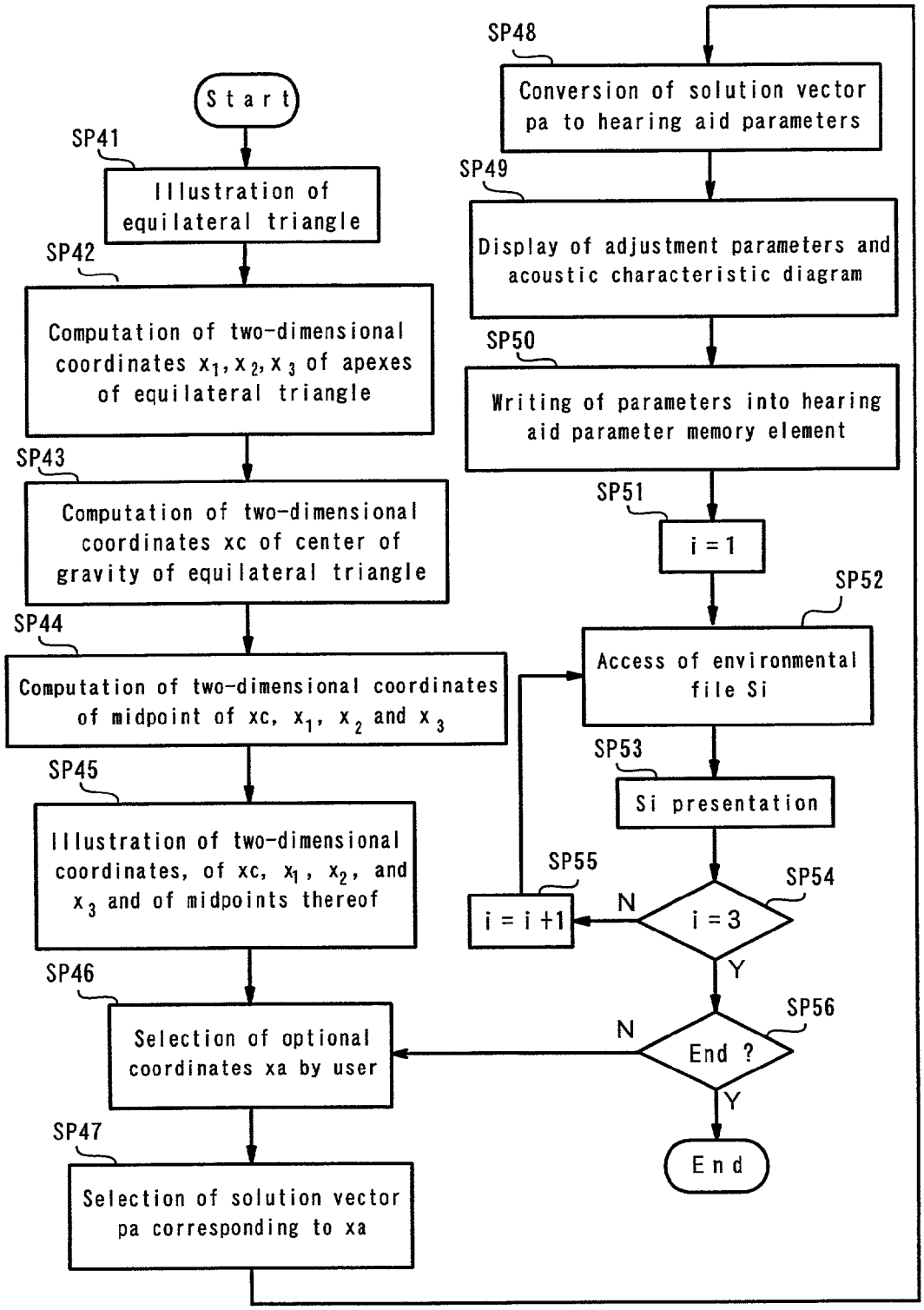
FIG. 5 is another flow chart for determining a single final optimum fitting value based on a result available from the method as shown in FIG. 2.

Next, another method for determining the final fitting value will be described with reference to a flow chart as shown in FIG. 5, using the optimum fitting values $F_1$, $F_2$, and $F_3$ for the three types of sound sources $S_1$, $S_2$, and $S_3$ which have been found by use of the flow chart as shown in FIG. 2.

First, the contents of steps SP 41 to SP 48 are the same as those of steps SP 21 to SP 28 of the flow chart as shown in FIG. 3 and therefore further explanation is omitted.

Figure 6:
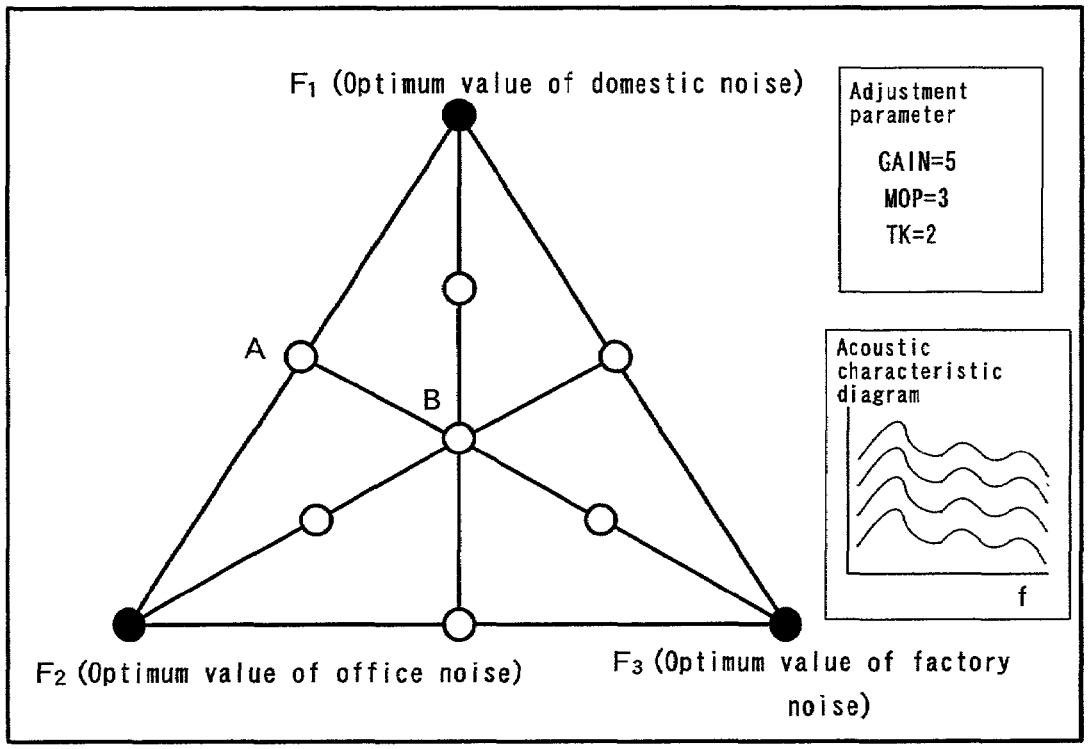
FIG. 6 is a view showing one example of a two-dimensional space used in a method as shown in FIG. 5.

Next, in step SP 49, as shown in FIG. 6, adjustment parameters (e.g. values such as an acoustic gain: GAIN=5, output limit: MOP=3, and knee point of input/output functions: TK=2) of the programmable hearing aid 4 and the acoustic function diagram (e.g. frequency response diagram for each input/output sound pressure level) corresponding to the coordinates $x_a$ in the two-dimensional space are displayed on the screen of the display element 3*c*.

Thus, by displaying the adjustment parameter values of the programmable hearing aid 4 and the acoustic characteristic diagram corresponding to the coordinates $x_a$ in the two-dimensional space on the screen of the display element 3*c*, not only the subject, but also an operator in charge of the parameter adjustment can visually grasp the adjusting conditions for the hearing aid. It is therefore possible to set the optimum adjustment parameter value of the hearing aid efficiently and correctly.

In FIG. 6, a visual diagram which is displayed on the screen of the display element 3*c* is set as frequency responses which are generated by the solution vector $p_a$ corresponding to $x_a$. However, the diagram in this case may not be that of the frequency responses, but a diagram based on the acoustic information expressed by the solution vector $p_a$. For example, if the hearing aid is a type (the so-called AGC hearing aid or non-linear hearing aid) which can change the input/output functions of the sound, the input/output functions may be a visual diagram.

Also, the diagram that is displayed on the screen of the display element 3*c* may be a time waveform of the output sound of the hearing aid when a specified sound signal is input to the hearing aid. The input sound in this case may use any of the sound sources $S_1$, $S_2$, and $S_3$, or other sound signals.

The diagram that is displayed on the screen of the display element 3*c* may be a sound spectrogram of the output sound of the hearing aid when a specified sound signal is input to the hearing aid. The input sound in this case may use any of the sound sources $S_1$, $S_2$, and $S_3$, or other sound signals.

The contents of steps SP 50 to SP 56 are the same as those of steps SP 29 to SP 35 of the flow chart as shown in FIG. 3 and therefore further explanation is omitted.

According to the depicted embodiments of the present invention, the fitting operation is performed using three types of environmental sounds $S_1$, $S_2$, and $S_3$. However, the operation may be performed using more than one or more than three types of environmental sounds.

According to the depicted embodiments of the present invention, the diagram that is illustrated in the two-dimensional space is always an equilateral triangle. However, the shape of the triangle may be determined according to a ratio of the Euclidean distance between the solution vectors $F_1$, $F_2$, and $F_3$, each of which is a multidimensional vector. The shape of the triangle may also be determined and illustrated by mapping the solution vectors $F_1$, $F_2$, and $F_3$ in the two-dimensional space using MDS (Multidimensional Scaling), a self-organizing mapping technique and the like.

Further, according to the depicted embodiments of the present invention, the coordinates to be illustrated are limited to ten points. However, the number of coordinates to be illustrated may not be determined, wherein the same treatment may be performed for all coordinates in the two-dimensional space.

Still further, according to the depicted embodiments of the present invention, the solution vector corresponding to the optional coordinate that the user has indicated is determined by computing the mean solution vector of which the component is a mean value of each component, based on known solution vectors $F_1$, $F_2$, and $F_3$. However, the solution vector may be determined by the Euclidean distance between each solution vector, the evaluation value $E_{ik}$ for a plurality of solution vectors which are found by use of the flow chart as shown in FIG. 2, and the like.

A hearing aid fitting apparatus according to a second embodiment of the present invention has the same construction as in FIG. 1 and therefore further explanation is omitted.

An operation of the hearing aid fitting apparatus according to the second embodiment will now be described. A method for determining a final fitting value is shown in a flow chart of FIG. 7, using the optimum fitting values $F_1$, $F_2$, and $F_3$ for the three types of sound sources $S_1$, $S_2$, and $S_3$ and the value $E_{ik}$ for various fitting values which are found by the flow chart as shown in FIG. 2.

First, in step SP 61, the optimum fitting values $F_1$, $F_2$, and $F_3$ obtained by the method shown in FIG. 2 are acquired at the optimum solution vector acquiring element 3*a*, and each of Euclidean distance $d_{12}$, $d_{13}$, and $d_{23}$ between the optimum fitting values $F_1$, $F_2$, and $F_3$ is computed.

In step SP 62, a triangle, the sides of which are the Euclidean distances $d_{12}$, $d_{13}$, and $d_{23}$ long, is presumed by the two-dimensional coordinate computing element 3*b*, and coordinates $x_1$, $x_2$, and $x_3$ of the optimum fitting values $F_1$, $F_2$, and $F_3$ in the two-dimensional space are computed. These coordinates $x_1$, $x_2$, and $x_3$ may be found by enlarging or reducing the values of the Euclidean distances $d_{12}$, $d_{13}$, and $d_{23}$, while maintaining the ratio between the Euclidean distances $d_{12}$, $d_{13}$, and $d_{23}$, so that the triangle can be illustrated in an appropriate size on the screen.

When the triangle, the sides of which are the Euclidean distances $d_{12}$, $d_{13}$, and $d_{23}$ long, can not be formed (e.g. $d_{12}+d_{13}<d_{23}$), the coordinates $x_1$, $x_2$, and $x_3$ may be computed by selectively adjusting each value so that the user can easily perform the operation. In this case, for example, the diagram to be illustrated may not be a triangle, but a line segment, wherein $x_1$ may be located on a coordinate at which the ratio between the distance of the coordinate $x_1$ and the coordinate $x_2$ in the two-dimensional space, on a line segment connecting the coordinate $x_2$ to the coordinate $x_3$ and the distance of the coordinate $x_1$ and the coordinate $x_3$ on the two-dimensional space is $d_{12}:d_{13}$. The coordinate $x_1$ may also be illustrated on two points where the distance from the coordinate $x_2$ is $d_{12}$ and the distance from the coordinate $x_3$ is $d_{13}$, on the line segment.

Figure 8:
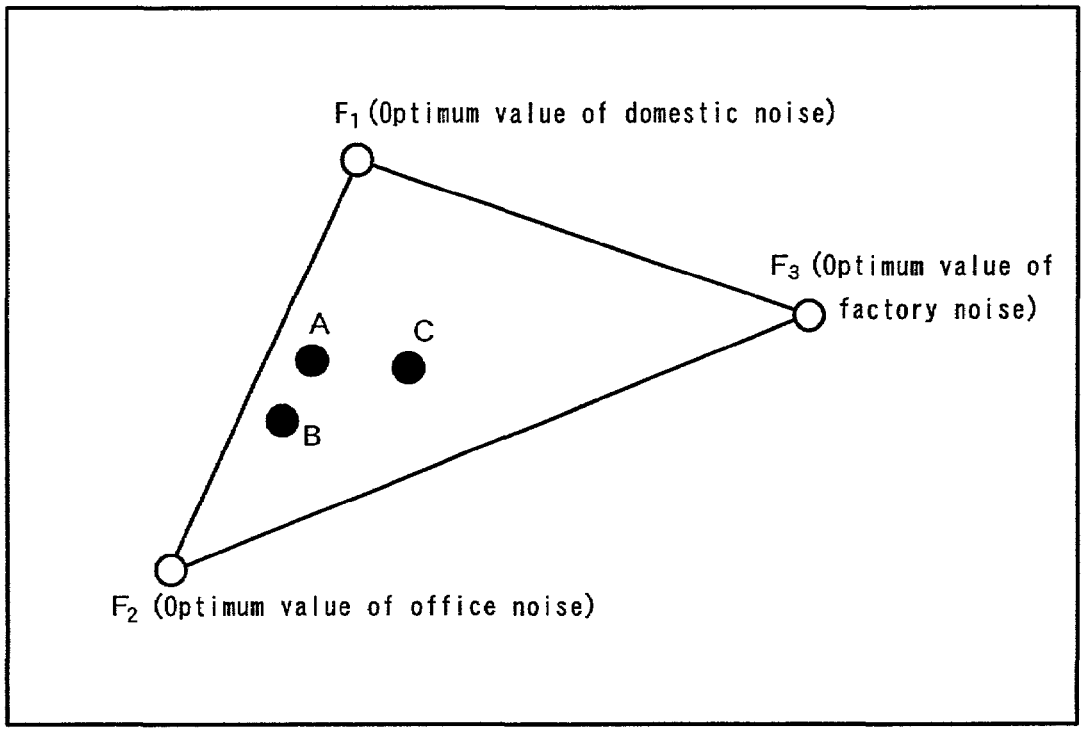
FIG. 8 is a view showing one example of a two-dimensional space used in a method as shown in FIG. 7.

Next, in step SP 63, positions of the coordinates $x_1$, $x_2$, and $x_3$ are illustrated on the screen by the display element 3*c*. FIG. 8 shows one example of the two-dimensional space illustrated on the screen.

In step SP 64, the user indicates an optional position in the two-dimensional space as shown in FIG. 8, referring to the positions of the three apexes.

Then, the coordinate acquisition element 2*a* acquires the coordinate $x_4$ of the indicated position in the two-dimensional space. For example, when the user's workplace is an office and the hearing aid is mainly used in his workplace and in his residence after he returns home, he indicates a position such as that shown by a point A of FIG. 8.

Next, in step SP 65, distances d 14, d 24, and d 34 of the coordinates $x_1$, $x_2$, and $x_3$ and the coordinate $x_4$ in the two-dimensional space are computed. In step SP 66, a candidate $P_h$ for the solution vector is found so that the ratio of the Euclidean distance relative to the optimum fitting values $F_1$, $F_2$, and $F_3$ is $d_{14}:d_{24}:d_{34}$ respectively.

The ratio of the Euclidean distances $d_{14}:d_{24}:d_{34}$ may be provided with an optional width such as $(d_{14}+a):(d_{24}+a):(d_{34}+a)$ or $(d_{14}\times a):(d_{24}\times a):(d_{34}\times a)$. For example, when the number of "h" of the solution vector candidates $P_h$ is increased, the solution vector candidate is not simply found as the ratio of the Euclidean distances, $d_{14}:d_{24}:d_{34}$, but, as the ratio of $(d_{14}+a):(d_{24}+a):(d_{34}+a)$ stated above, $P_h$ on three types of ratio of a =−1.0, 0, 1.0 are to be all the solution vector candidates. It is to be noted that the number of "h" varies with the number of bits for the value of the distances $d_{14}$, $d_{24}$, $d_{34}$, the value of a, and the adjustment value (the component of the solution vector) of each adjustment function.

Next, in step SP 67, a similarity $Q_{ikh}$ between each solution vector candidate $P_h$ and the solution vector $P_{ik}$ with higher evaluation value (in the present embodiment, $E_{ik}>3$) is computed within the solution vectors $P_{ik}$ found by use of the flow chart as shown in FIG. 2. A similarity is an index expressing the similarity of the solution vector $P_h$ with $p_{ik}$. In the present embodiment, the similarity is an inverse number of the Euclidean distances of both solution vectors $P_h$ and $p_{ik}$.

In step SP 68, a weighting to the computed similarity with the user's evaluation which has been acquired in advance by multiplying the similarity $Q_{ikh}$ by the value $E_{ik}$ is conducted, wherein the solution vector candidate $P_h$ is found so that $Q_{ikh}\times E_{ik}$ is maximum.

In step SP 69, the solution vector candidate $P_h$ of which the product of $Q_{ikh}\times E_{ik}$ is maximum is converted as a fitting value to a parameter of the programmable hearing aid 4 from the parameter writing element 2*c*. In step SP 70, the parameter is then written into the parameter memory element 5 of the programmable hearing aid 4.

In steps SP 71 and SP 72, a file of the environmental sound (the domestic noise $S_1$) corresponding to the optimum fitting value $F_1$ is reproduced at the sound source signal converting element 1*b* and the sound source presenting element 1*d*. The reproduced environmental sound file is then presented from the speaker 6 to the programmable hearing aid 4. The subject listens to an output sound (i.e. the domestic noise $S_1$ hearing aid-processed according to the solution vector candidate $P_h$) of the programmable hearing aid 4.

In steps SP 72 to SP 75, after the subject listens to the output sound of the programmable hearing aid 4 for all of the three types of environmental sounds $S_1$, $S_2$, and $S_3$, if in step SP 76, the subject is satisfied with the current fitting value $P_h$, the fitting operation is completed. If not satisfied, the program goes back to step SP 64, wherein the above-mentioned operations are repeatedly performed.

In this case, when the user feels it easier to hear under the domestic noise $S_1$ with the current fitting value $P_h$, but feels it hard to hear under the office noise $S_2$, the optional coordinate $x_4$ is, for example, located at a point B. If the user feels it easier to hear both under the domestic noise $S_1$ and the office noise $S_2$, but he wants to feel a bit more comfortable hearing even under the factory noise $S_3$, the optional coordinate $x_4$ 4 is located at a point C.

Figure 9:
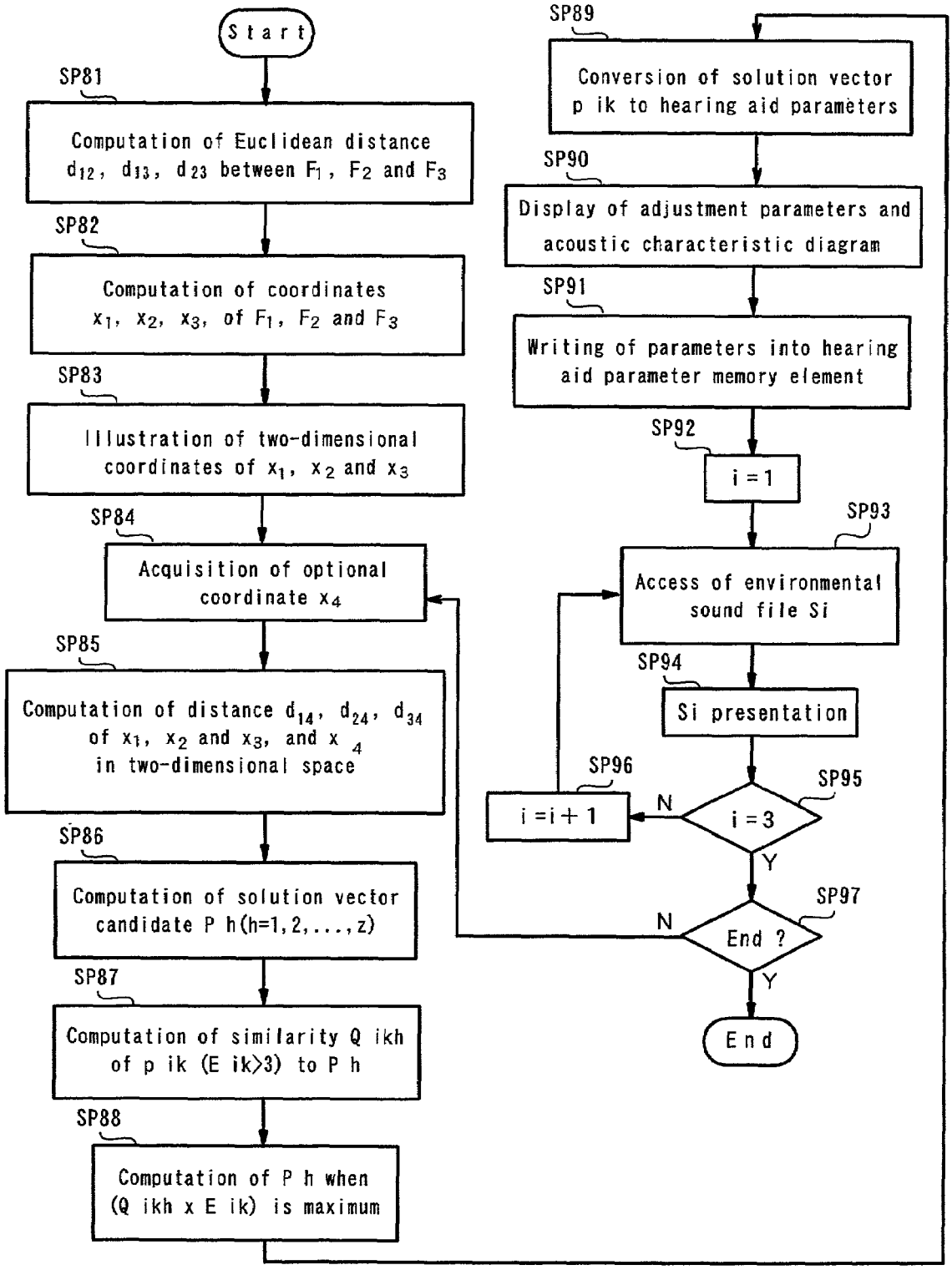
FIG. 9 is another flow chart for determining a single final optimum fitting value based on a result available from the method as shown in FIG. 2.

Next, another method for determining a final fitting value is described by a flow chart as shown in FIG. 9, using the optimum fitting values $F_1$, $F_2$, and $F_3$ for the three types of sound sources $S_1$, $S_2$, and $S_3$ and the evaluation value $E_{ik}$ for various fitting values, found by the flow chart as shown in FIG. 2.

Figure 7:
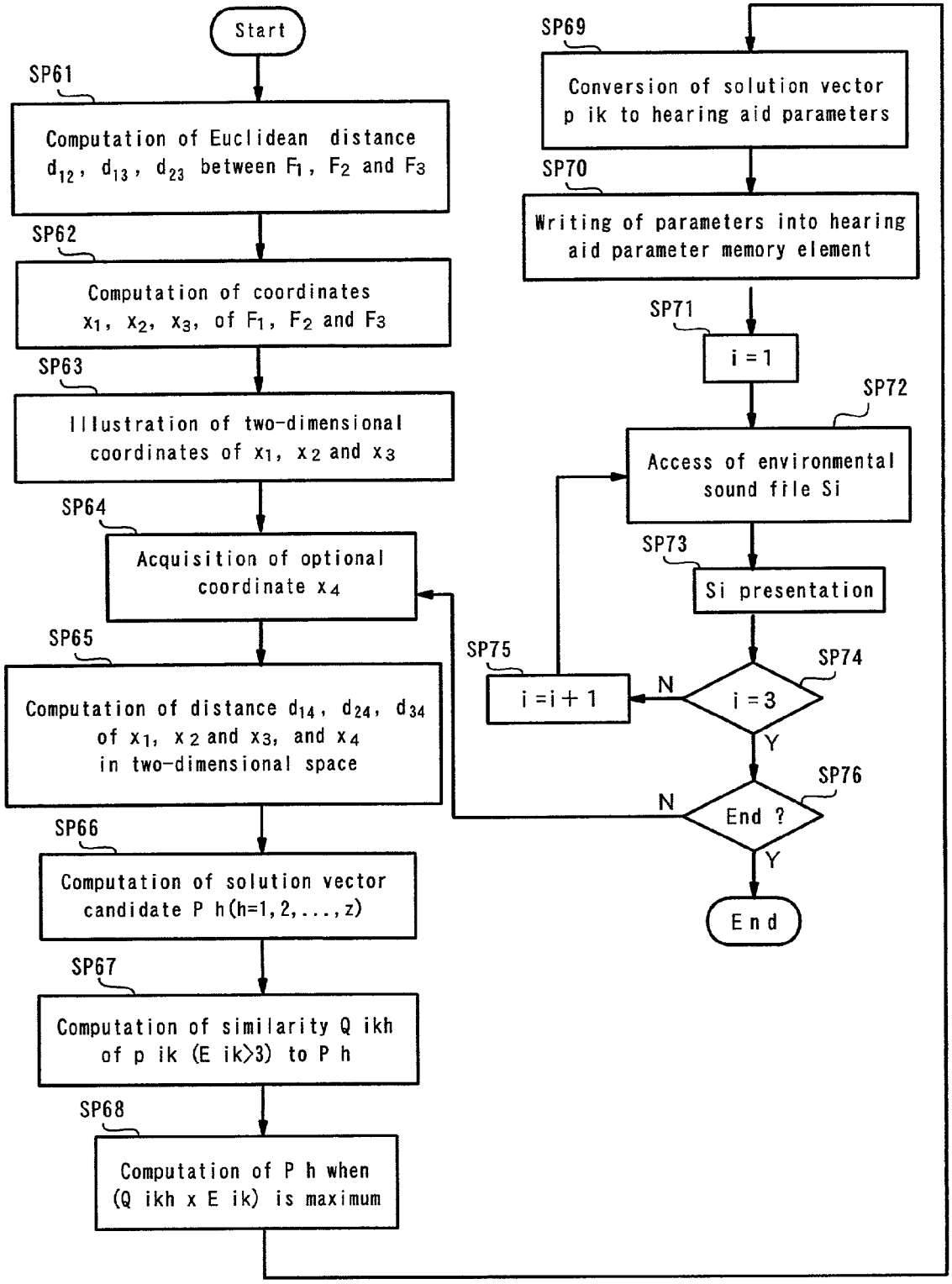
FIG. 7 is a flow chart of a hearing aid fitting apparatus according to a second embodiment of the present invention for determining a single final optimum fitting value based on a result available from the method as shown in FIG. 2.

First, the contents of steps SP 81 to SP 89 are the same as those of steps SP 61 to SP 69 of the flow chart as shown in FIG. 7 and therefore further explanation is omitted.

Figure 10:
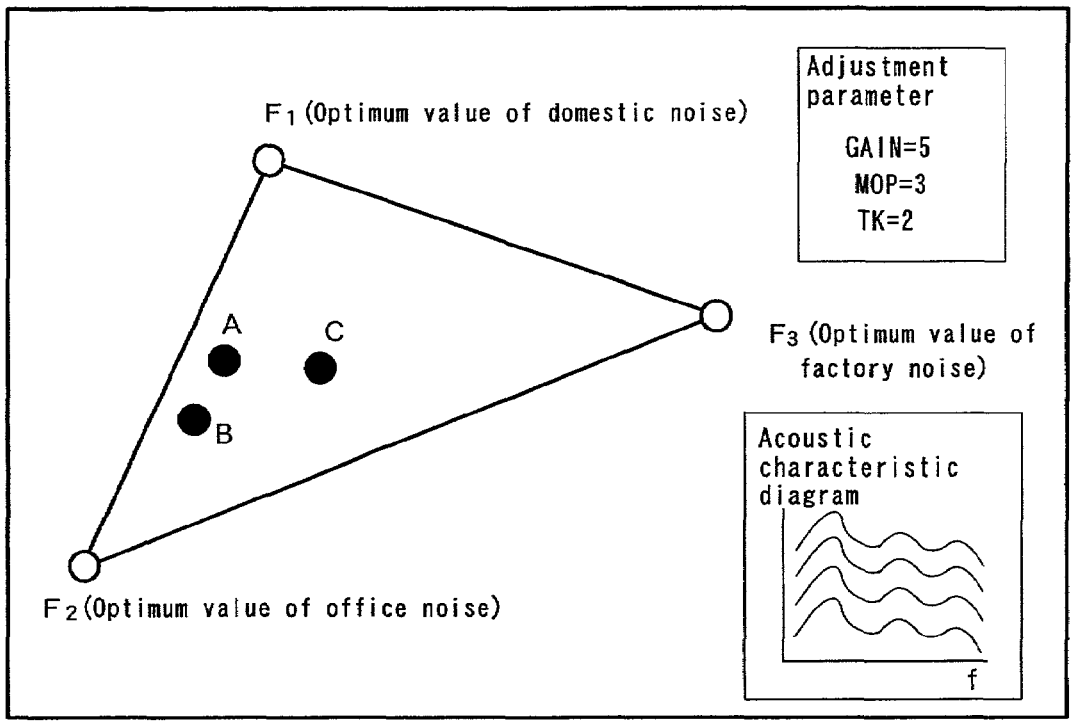
FIG. 10 is a view showing one example of a two-dimensional space used in a method as shown in FIG. 9.

In step SP 90, as shown in FIG. 10, an adjustment parameter (e.g. values of an acoustic gain: GAIN=5, an output limit: MOP=3, a knee point of the input/output functions: TK=2, and the like) of the programmable hearing aid 4 and the acoustic characteristic diagram (e.g. frequency response diagram for each input/output sound pressure level) corresponding to the coordinate $x_4$ in the two-dimensional space are displayed on the screen of the display element 3*c*.

Thus, by displaying, on the screen of the display element 4*c*, the adjustment parameter of the programmable hearing aid 4 and the acoustic characteristic diagram corresponding to the coordinates $x_4$ in the two-dimensional space, both the subject and an operator who is in charge of parameter adjustment can visually grasp the adjusting conditions of the hearing aid. It is therefore possible to set the optimum adjustment parameter value of the hearing aid efficiently and correctly.

In FIG. 10, a visual diagram displayed on the screen of the display element 3*c* shows a frequency response which is generated by the solution vector $P_h$ corresponding to $x_4$. However, if the visual diagram is one based on the acoustic information expressed by the solution vector $P_h$, the diagram in this case may not be the frequency response. For example, if the hearing aid is a type (the so-called AGC hearing aid or non-linear hearing aid) that can change the input/output functions of a sound, the input/output functions may be illustrated in the visual diagram.

Also, the diagram displayed on the screen of the display element 3*c* may be a time waveform of the output sound of the hearing aid when a specified sound signal is input to the hearing aid. The input sound in this case may use any of the sound sources $S_1$, $S_2$, and $S_3$, or another sound signal.

The diagram displayed on the screen of the display element 3*c* may be a sound spectrogram of the output sound of the hearing aid when a specified sound signal is input to the hearing aid. The input sound in this case may use any of the sound sources $S_1$, $S_2$, and $S_3$, or another sound signal.

The contents of steps SP 91 to SP 97 are the same as those of steps SP 70 to SP 76 as shown in FIG. 7 and therefore further explanation is omitted here.

According to the first and second embodiments of the present invention, the fitting operation is performed using three types of environmental sounds $S_1$, $S_2$, and $S_3$, but the fitting operation may be performed using more than one or more than three types of environmental sounds.

According to the first and second embodiments of the present invention, positions of each multidimensional vector are displayed in the two-dimensional space using the ratio of the Euclidean distance between each multidimensional vector. However, the positions of multidimensional vectors may be displayed in the two-dimensional space using the MDS, the self-organizing mapping technique, and the like.

Also, according to the second embodiment of the present invention, the similarity $Q_{ikh}$ is found only on the solution vector $p_{ik}$ of $E_{ik}>3$, but the conditions of the solution vector $p_{ik}$ may be other than $E_{ik}>3$. The similarity $Q_{ikh}$ may also be found on all solution vectors $p_{ik}$ without imposing any conditions.

In addition, the solution vector candidate for finding the similarity $Q_{ikh}$ is not necessarily limited to $p_{ik}$. However, all solution vectors $p_{ik}$ in which each solution vector $p_{ik}$ and the Euclidean distance are close may be the solution vector candidate $P_h$.

According to the second embodiment of the present invention, the similarity $Q_{ikh}$ is simply the inverse number of the solution vector distance of the solution vector $p_{ik}$, but this similarity may be the index that can express the similarity of both vectors. For example, the similarity may be the inverse number of the Euclidean distance after the specified weighting is performed on the components of each solution vector $p_{ik}$.

According to the first and second embodiments of the present invention, the method to obtain the optimum fitting values for various sound sources and the evaluation values for various fitting values is performed by use of the flow chart as shown in FIG. 2.

However, the acquisition of these values may be performed using the interactive genetic algorithm.

In the interactive genetic algorithm, the optimum value specified in the sound source is found, and the evaluation value for various solution vectors is also obtained in the process of determining the optimum value. By recording these values, they can be effectively used in the present method.

Namely, the interactive genetic algorithm for which the sound sources are the domestic noise $S_1$, the office noise $S_2$, and the factory noise $S_3$ is performed to find the optimum solution vectors $F_1$, $F_2$, and $F_3$ respectively for each sound source. At the same time, a plurality of solution vectors which have been obtained in the process of evolution of the interactive genetic algorithm are treated as $p_{ik}$ and the evaluation values for these are treated as $E_{ik}$. The present invention is performed in such a condition.

In the first and second embodiments of the present invention, only the hearing aid fitting operation is explained, but the application of the present optimum solution method is not limited to the hearing aid fitting operation. For example, this method is applicable to problems for which the evaluation criteria are subjective and unclear, that can not be adjusted based on the quantitative evaluation criteria, including the adjustment of the acoustic characteristics and the image characteristics which are suited to the preferences of the individual, such as correction of visual acuity using spectacles, contact lens, or the like and the design of interior goods and the like which are suited to the preferences of the individual. This method is particularly applicable to all the problems in which the optimum value under a plurality of conditions and the individual's subjective evaluation can be obtained in advance.

Also, in the first and second embodiments of the present invention, only the hearing aid fitting operation is explained, but the present optimum solution method can be used to produce an image suited to the preferences of the use. In this case, for example, when the values of resolution and brightness of the image to be targeted are set at the different values for each coordinate on the screen so as to make the optimum image adjustment, the solution vector of which the component is resolution and brightness for each coordinate is produced. The present invention can be performed in such a condition.

Figure 11:
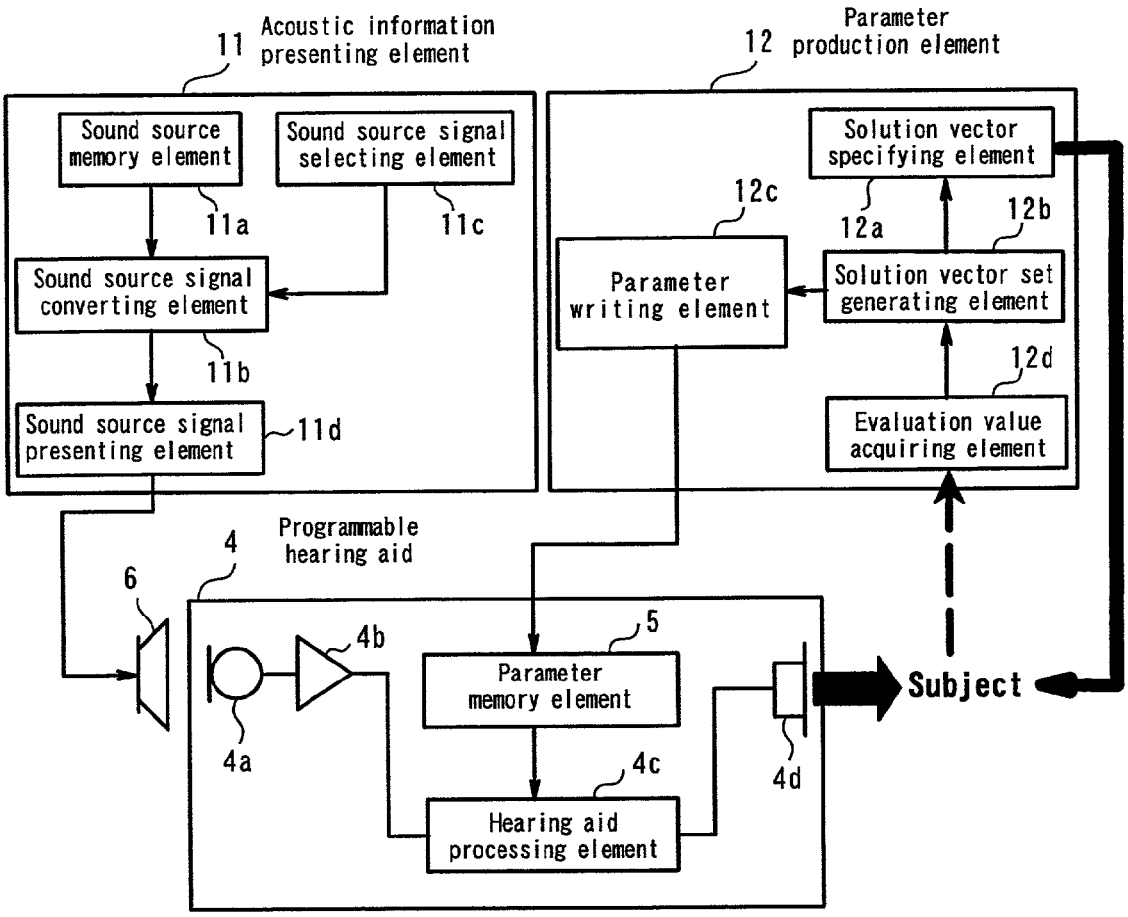
FIG. 11 is a schematic diagram of a hearing aid fitting apparatus according to a third embodiment of the present invention.

Next, a hearing aid fitting apparatus according to a third embodiment of the present invention, as shown in FIG. 11, comprises an acoustic information presenting element 11 and a parameter production element 12. As the same reference numerals are used as those shown in FIG. 1, further explanation is omitted because they have the same contents.

The acoustic information presenting element 11 is composed of a sound source memory element 11*a*, a sound source signal converting element 11*b*, a sound source signal selecting element 11*c*, and a sound source presenting element 11*d*. The parameter production element 12 is composed of a solution vector expressing element 12*a*, a solution vector set generating element 12*b*, a parameter writing element 12*c*, and an evaluation value acquiring element 12*d*.

The sound source memory element 11*a* stores a file in which a sound source (acoustic information) used in the fitting operation is digitally recorded and a calibration sound file. The sound source and calibration sound files are, for example, composed of digital data in a WAVE file format.

The sound source signal converting element 11*b* has a function of not only accessing the sound source file stored in the sound source memory element 11*a*, but also of converting the digital data stored in the sound source file to an analog signal.

The sound source presenting element 11*d* amplifies or attenuates the sound source signal (analog signal) output from the sound source signal converting element 11*b* at a predetermined level and then presents the amplified or attenuated signals to the programmable hearing aid 4 using the speaker 6 and the like.

The solution vector expressing element 12*a* specifies a solution vector that is the elite from the preceding generation in a solution vector set to the user. The solution vector is composed of adjustment values of each adjustment function of the programmable hearing aid 4 to be targeted.

The solution vector set generating element 12*b* performs a genetic algorithm (GA) using each solution vector and an evaluation value by a subject to each solution vector which is obtained at the evaluation value acquiring element 12*d* so as to generate a new solution vector set.

The parameter writing element 12*c* has a function of writing the solution vector which is set at the solution vector set generating element 12*b* into the parameter memory element 5 of the programmable hearing aid 4 as parameters for the adjustment functions of the programmable hearing aid 4.

When the subject listens to a sound which has been processed at the hearing aid processing element 4*c* of the programmable hearing aid 4, the evaluation value acquiring element 12*d* acquires a value resulting from evaluation by the subject for the processed sound source.

Figure 12:
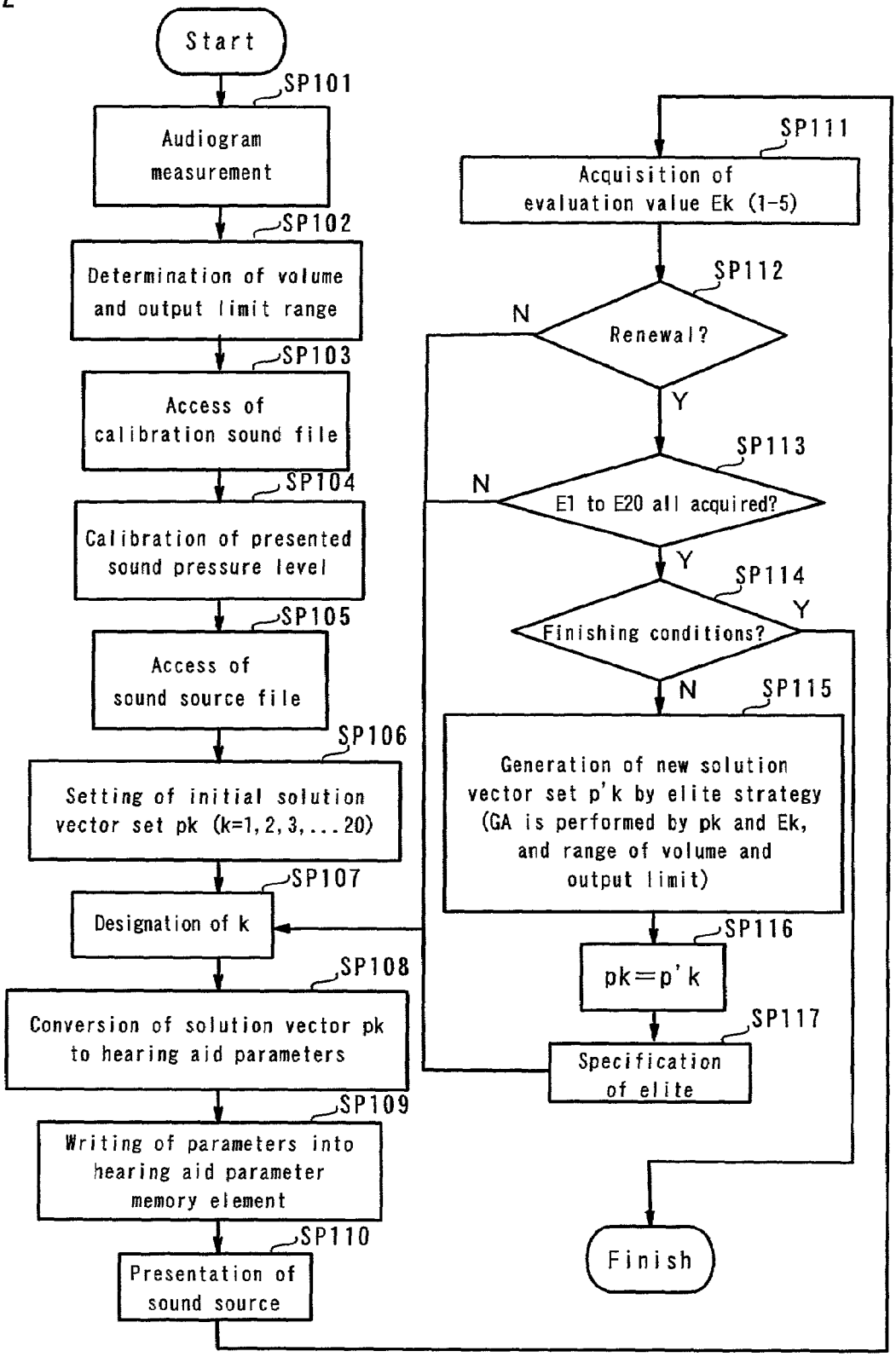
FIG. 12 is a flow chart of the hearing aid fitting apparatus according to the third embodiment of the present invention.

An operation of the hearing aid fitting apparatus as constructed above according to the third embodiment of the present invention will now be described with reference to a flow chart as shown in FIG. 12.

First, in step SP 101, an audiogram of a hearing impaired person is measured. In step SP 102, using the measured audiogram, a limit range for limiting a search area for an adjustment value of each of a volume control and an output limit is computed by a known hearing aid fitting formula so as not to output too large a sound or too small a sound during the fitting operation.

Next, in step SP 103, prior to the fitting operation, for a presented sound pressure level calibration when the sound source is presented, the sound source signal selecting element 11*c* is operated to access the calibration sound file from the sound source memory element 11*a*. The calibration sound file is then presented from the sound source presenting element 11*d*.

In step SP 104, the presented sound pressure level calibration is performed, using a sound level meter and the like, by controlling the amplification or attenuation degree of the sound source presenting element 11*d*.

Next, in step SP 105, a sound source file is accessed. A signal such as a speech sound is often used as the sound source.

In step SP 106, a set of an initial value of the solution vector, the so-called initial solution vector set $p_k$ (k=1, 2, 3. . . , n), which is composed of the adjustment values of each adjustment function of the programmable hearing aid 4, for performing the genetic algorithm (GA), is set. Here set n=20.

The initial solution vector set $p_k$ (k=1, 2, 3. . . , n) is determined at random using a random number and the like in the ordinary genetic algorithm (GA). However, in step SP 102 stated above, a limit on a search area for the adjustment value of each of the volume control and the output limit is provided so as not to output too large a sound or too small a sound during the fitting operation.

In step SP 107, one optional solution vector $p_k$ is designated from among twenty solution vectors $p_k$ set above. This designation is usually made by the subject himself.

In step SP 108, the designated solution vector $p_k$ is converted to parameters of the programmable hearing aid 4 by the parameter writing element 12*c*. In step SP 109, the parameters are written into the parameter memory element 5 of the programmable hearing aid 4.

In step SP 110, the sound source file accessed earlier is reproduced by the sound source signal converting element 11*b* and the sound source presenting element 11*d* and presented to the programmable hearing aid 4 from the speaker 6. The subject listens to the output sound (i.e. the sound source which has been hearing aid-processed in response to the solution vector $p_k$) of the programmable hearing aid 4.

In step SP 111, the evaluation value acquiring element 12*d* acquires the evaluation value $E_k$ by the subject of the presented sound, i.e. the solution vector $p_k$ at that time. The evaluation value $E_k$ is a numerical value expressing the subject's subjective value based on comfort and intelligibility of the presented sound, wherein there are 5 grades, of which the grade 1 expresses the lowest evaluation, while the grade 5 expresses the highest evaluation.

In step SP 112, if the subject requests renewal of the solution vector set, the program goes to step SP 113. If not, steps SP 107 to SP 111 are repeated.

In step SP 113, a judgment is made as to whether or not all evaluation values of $E_1$~$E_{20}$ have been acquired. If not acquired, the program goes to step SP 107, wherein the above-mentioned operations are repeated. On the other hand, if all evaluation values of $E_1$~$E_{20}$ have been acquired, a judgment is made, in step SP 114, as to whether or not the predetermined finishing conditions have been met.

In step SP 114, when a judgment is made that the predetermined finishing conditions have been met, the fitting operation is completed. The solution vector $p_k$ which has obtained the highest evaluation value within the current solution vector set $p_k$ (k=1, 2, 3. . . , n) is treated as a final fitting value.

"Predetermined finishing conditions" means those conditions for finishing the evolution of the genetic algorithm (GA). For example, by determining the number of evolutions in advance, the fitting operation may be automatically finished when the number reaches the predetermined number.

On the other hand, when a judgment is made that the finishing conditions have not been met, in step SP 115, selection, chiasma and mutation in the genetic algorithm (GA) are performed using the current solution vector set $p_k$ (k=1, 2, 3. . . , n) and the evaluation value $E_k$ for each solution vector $p_k$ so as to generate a new solution vector set $p'_k$.

Since the elite strategy is used here, the new solution vector set $p'_k$ always includes an a-unit of elite solution vectors of which the evaluation value $E_k$ ranks higher within $p_k$. In the embodiment of the present invention, a=2.

Then, the above-mentioned operations (SP 107 to SP 114) are performed again on the new solution vector set $p'_k$ (k=1, 2, 3. . . , n), but prior to these operations, in step SP 117, two elite solution vectors in the preceding generation solution vector set $p_k$ which are included in the solution vector set $p'_k$ are specified to the user.

In the embodiments of the present invention, the shape of an individual on the screen expressing the elite solution vector is changed for the specification purposes.

Figure 13:
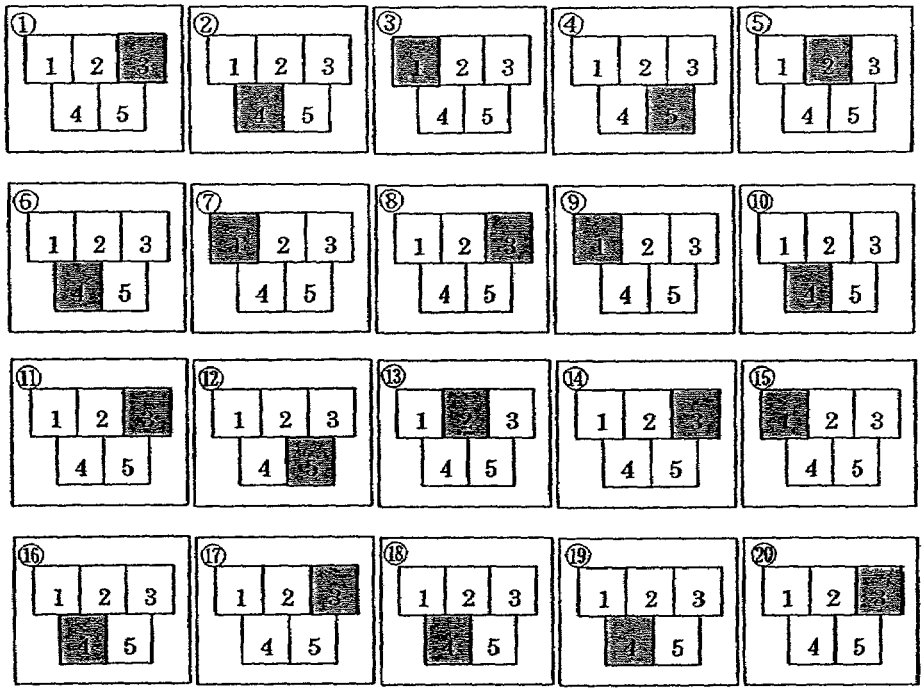
FIG. 13 is a view showing one example of an image-plane that specifies the elite.
Figure 13:
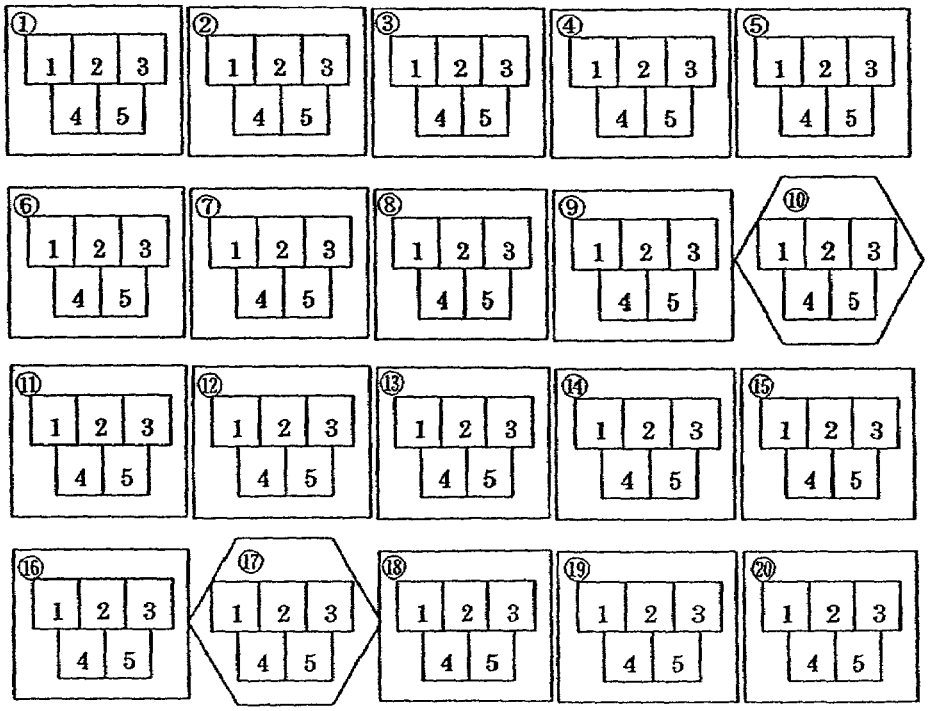

FIG. 13 shows one example of the screen displayed to the user when the solution vector set evolves from an initial solution vector set to the second generation including the elite. FIG. 13(*a*) shows the initial solution vector set and FIG. 13(*b*) shows a newly generated second-generation solution vector set. Twenty individuals (Nos. 1~20) enclosed by a four-sided figure show each solution vector. A numeral in each individual shows five grades of evaluation values, wherein the numeral that is painted out is the evaluation value assigned by the user to that solution vector.

In the embodiments of the present invention, as shown in FIG. 13(*a*), the individuals who have acquired the highest points in the first generation are No. 4 and No. 12, which are the elite.

Also, as shown in FIG. 13(*b*), Nos. 10 and 17 in the second generation have the same solution vectors as Nos. 4 and 12 in the first generation, wherein the elite are indicated by a hexagon.

In the embodiments of the present invention, the number of elite is two, but the number of individuals who acquire the evaluation value of 5 points is not always two in one generation. In this case, the number of elite may be selectively changed in response to the number of individuals who have acquired the highest evaluation value in that generation or two elite may also be determined at random from among the individuals who have acquired the highest evaluation value.

In the embodiments of the present invention, the number of elite is limited to two in one generation, but a different value from the above may be used according to the characteristics of the problems to be targeted.

Although not particularly shown in FIG. 12, the acquisition of the evaluation value $E_k$ need not always be performed after presentation of the sound source. The previous evaluation value $E_k$ is designed to be rewritable any time before the new solution vector $p'_k$ is generated.

Also, to avoid presentation of too large a sound or too small a sound, in steps SP 101 and SP 102, a range limit is provided for the adjustment values of a volume controller and an output limiter. However, provision of the range limit is not limited to these two controllers, but the range limit may be provided for other controllers such as an AGC controller and a tone controller, according to the purpose.

In addition, determination of a limit range of a search area of the solution vector $p_k$ is performed using the audiogram and a known fitting formula. However, by preparing a predetermined signal for inspection (a pure tone sound, a band noise, etc.) at the sound source memory element 1*a* in advance, the hearing threshold level (HTL) and/or the uncomfortable (loudness) level (UCL), the most comfortable (loudness) level (MCL), and the like of the subject are found using the inspection signal, wherein a limit may be provided for the value of the controllers in response to the value found.

The number of evolutions of the genetic algorithm (GA) is set as the finishing conditions, but the fitting operation may be completed when the solution vector $p_k$ of $E_k$=5 has exceeded a predetermined number or when the mean value of $E_k$ has exceeded a predetermined value.

Also, the fitting operation may be completed when the convergent conditions of the genetic algorithm (GA) are estimated from the Euclidean distance between each solution vector $p_k$ and the like and the convergent conditions have exceeded a fixed level.

The solution vector $p_k$ that has acquired the highest evaluation value of the current solution vector set $p_k$ (k=1, 2, 3. . . , n) is treated as the final fitting value, but it is considered that there are a plurality of solution vectors $p_k$ with the highest number of points (5 points). In this case, any one of these may be selected at random as the final fitting value or the user may be requested again to listen to these solution vector $p_k$ with the highest number of point to select his preferred solution vector $p_k$.

In the embodiments of the present invention, specification of the elite for the user is conducted by changing the shape of the elite individual. However, since this is only intended to specify the elite individual for the user, the specification may be conducted by changing the color of the individual, or it may be conducted by changing the brightness thereof.

In the embodiments of the present invention, only the hearing aid fitting operation is described. However, the application of the present system optimization adjusting method is not limited to hearing aid fitting. The system optimization adjusting method is, for example, applicable to problems of which the evaluation criteria are subjective and unclear, that can not be adjusted based on the quantitative evaluation criteria, including the adjustment of the acoustic characteristics and the image characteristics which are suited to the preferences of the individual, such as correction of a visual acuity using spectacles, a contact lens and the like and design of interior goods and the like suited to the preferences of the individual. The system optimization adjusting method is particularly applicable to all problems for which an optimum value under a plurality of conditions and the individual's subjective evaluation can be obtained.

Figure 14:
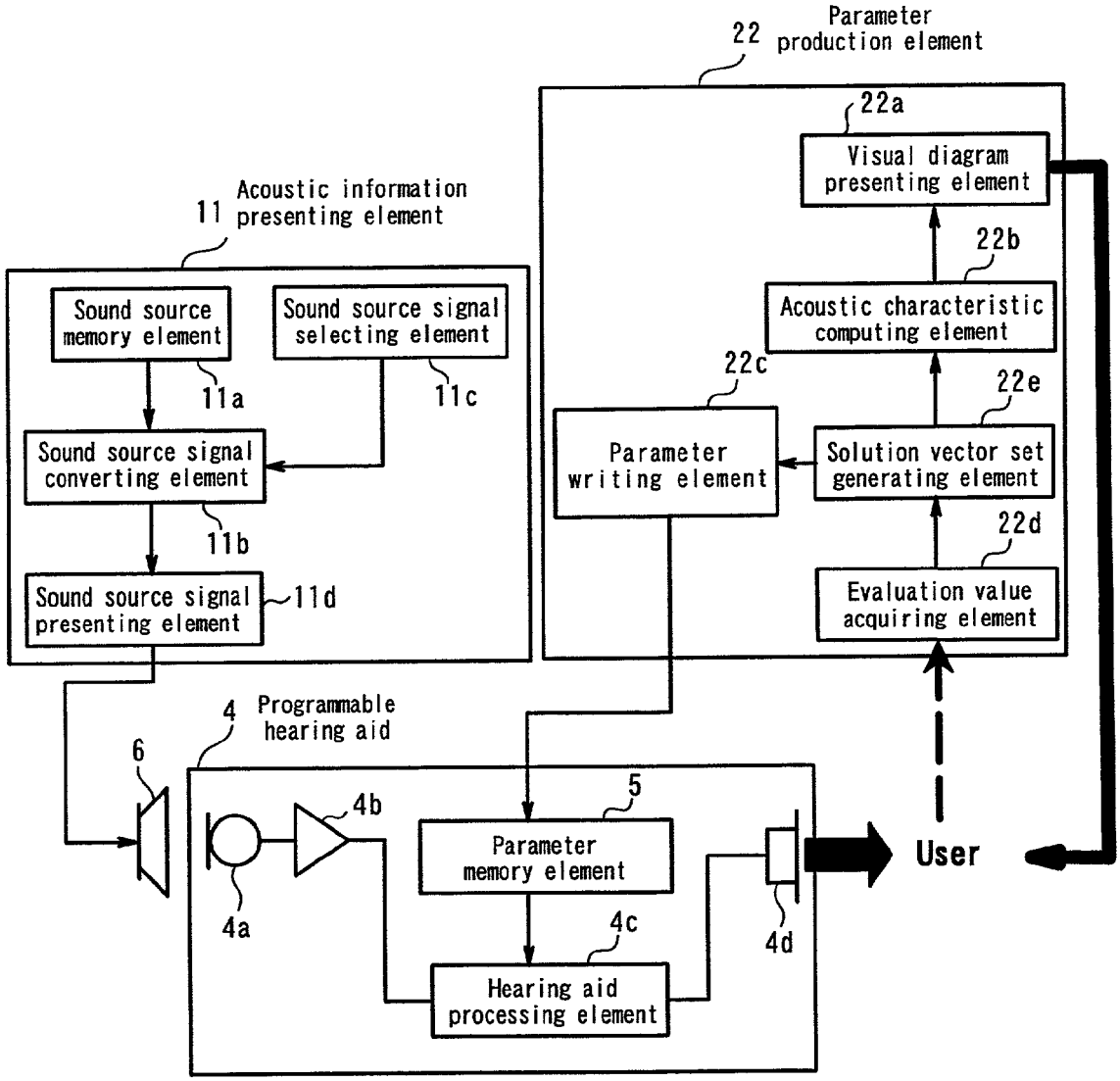
FIG. 14 is a schematic diagram of a hearing aid fitting apparatus according to a fourth embodiment of the present invention.

Next, a hearing aid fitting apparatus according to a fourth embodiment of the present invention comprises, as shown in FIG. 14, the acoustic information presenting element 11 and a parameter production element 22. The same reference numerals as those of FIGS. 1 and 11 have the same contents and further description is omitted.

The parameter production element 22 is composed of a visual diagram presenting element 22*a*, an acoustic characteristic computing element 22*b*, a parameter writing element 22*c*, an evaluation value acquiring element 22*d*, and a solution vector set generating element 22*e*.

The visual diagram presenting element 22*a* visually presents an acoustic characteristic for each solution vector displayed on a screen to a user.

The acoustic characteristic computing element 22*b* computes from the value of the components of each solution vector an acoustic characteristic (frequency response in the embodiments of the present invention) of a hearing aid generated from the solution vector. The solution vector here is composed of adjustment values for each adjustment function of the programmable hearing aid 4 to be targeted.

The parameter writing element 22*c* has a function of writing the solution vector which has been set in the solution vector set generating element 22*e* into the parameter memory element 5 of the programmable hearing aid 4 as parameters of the adjustment functions of the programmable hearing aid 4.

The evaluation value acquiring element 22*d* acquires a value assigned by the user to the processed sound source when the user listens to the sound source which has been processed in the hearing aid processing element 4*c* of the programmable hearing aid 4.

The solution vector set generating element 22*e* performs the genetic algorithm (GA) using each solution vector and the evaluation value assigned by the user to each solution vector which has been obtained in the evaluation value acquiring element 22*d* to generate a new solution vector set.

Figure 15:
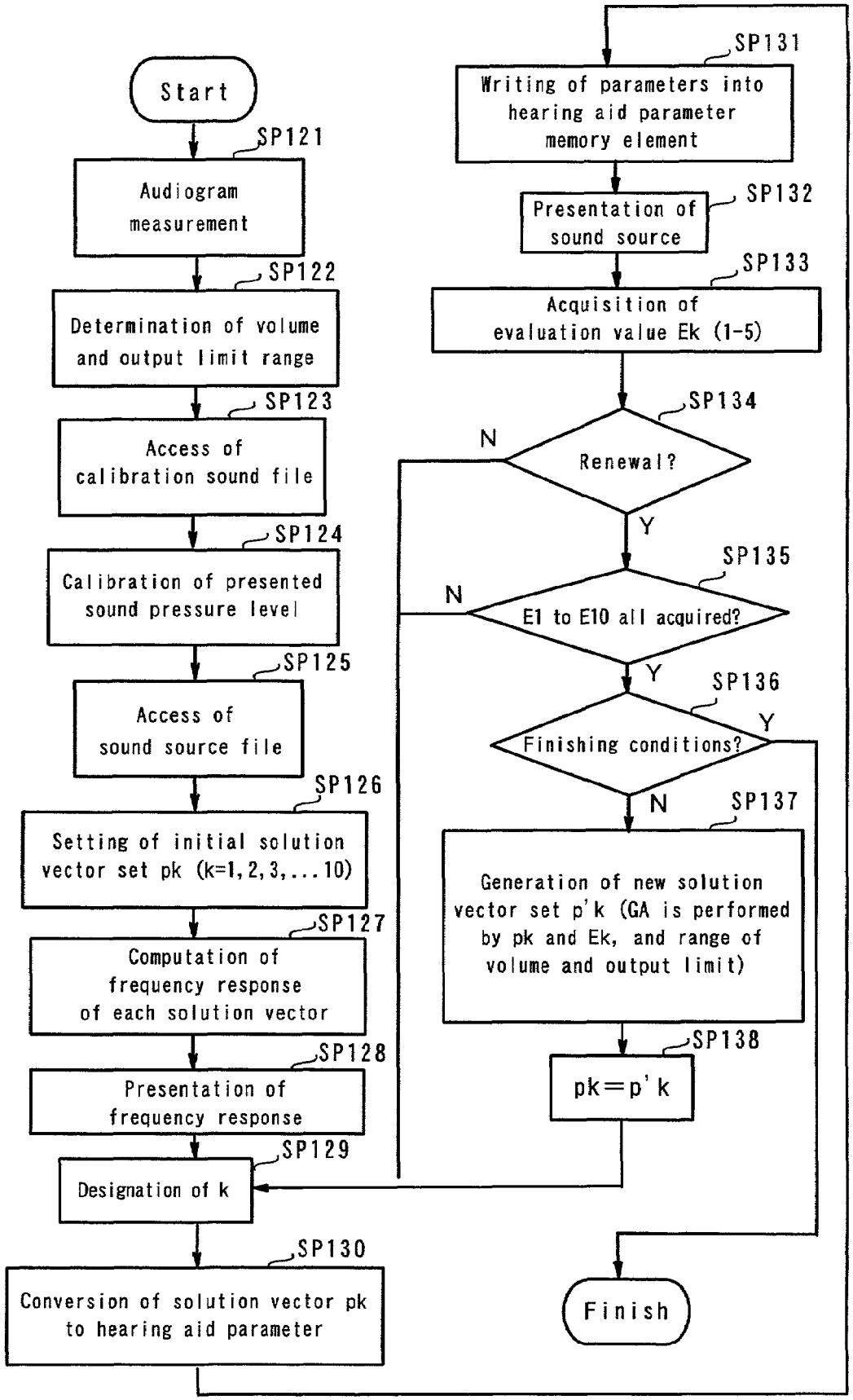
FIG. 15 is a flow chart of the hearing aid fitting apparatus according to the fourth embodiment of the present invention.

An operation of the hearing aid fitting apparatus as constructed above according to the fourth embodiment of the present invention will be described with reference to a flow chart as shown in FIG. 15. In the embodiment of the present invention, the visual diagram is treated as frequency responses generated by each solution vector.

First, in step SP 121, an audiogram of the hearing impaired person is measured. In step SP 122, using the measured audiogram, a limit range for limiting a search area for an adjustment value of each of a volume control and an output limit is computed by a known hearing aid fitting formula so as not to output too large a sound or too small a sound during the fitting operation.

Next, in step SP 123, prior to the fitting operation, for presented sound pressure level calibration when a sound source is presented, the sound source signal selecting element 11*c* is operated to access a calibration sound file from the sound source memory element 11*a*. The accessed sound file is then presented from the sound source presenting element 11*d*.

In step SP 124, using a sound level meter and the like, the presented sound pressure level calibration is carried out by controlling the amplification and attenuation degree of the sound source presenting element 11*d*.

Next, in step SP 125, a sound source file is accessed. A signal such as a speech sound is often used as the sound source.

In step SP 126, a set of an initial value of a solution vector, the so-called initial solution vector set $p_k$ (k=1, 2, 3. . . , m), which is composed of adjustment values for each adjustment function of the programmable hearing aid 4 is set to perform the genetic algorithm (GA). Here set m=10.

The initial solution vector set $p_k$ (k=1, 2, 3. . . , m) is determined at random in the ordinary genetic algorithm (GA) using a random number and the like, but in step SP 122, a limit is provided in a search area for adjustment values for a volume control and an output limit so as not to output too large a sound or too small a sound during the fitting operation.

Next, in step SP 127, the frequency responses for the ten solution vectors $p_k$ set above are computed in the acoustic characteristic computing element 22*b*. It is also possible to compute this from the value of the components of the solution vector $p_k$ of which the component (tone controller etc.) affects the shape of the frequency responses of the hearing aid. When the frequency response for a plurality of solution vectors $p_k$ are measured in advance, computation may be performed based on these values, or when the frequency responses for all solution vectors $p_k$, are measured in advance, the data available from the measurement may be used as is. In step SP 128, the frequency responses corresponding to each solution vector $p_k$ computed in step SP 127 are presented to the user by the visual diagram presenting element 22*a*.

Figure 16:
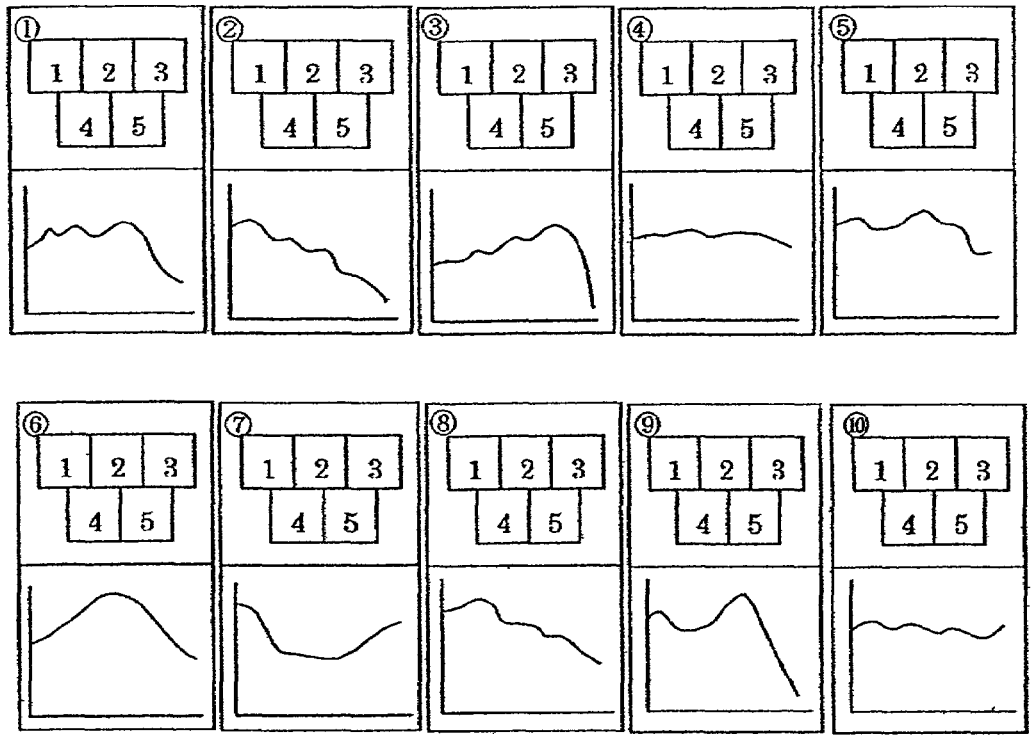
FIG. 16 is a view showing one example of an image-plane that is presented to a user.

In FIG. 16, one example of the solution vector $p_k$ and the frequency responses on the screen to be presented to the user is shown. In FIG. 16, ten individuals enclosed by a four-sided figure show each solution vector $p_k$, wherein numerals in each individual show 5 grades of evaluation value to the solution vector $p_k$. Diagrams provided under each individual show the frequency responses generated by the solution vector $p_k$, wherein the abscissa shows frequency, while the ordinate shows power.

Next, in step SP 129, when the user designates an optional solution vector $p_k$ on the screen, in step SP 130, the designated solution vector $p_k$ is converted to parameters of the programmable hearing aid 4 by the parameter writing element 22*c*. In step SP 131, the parameters are written into the parameter writing element 5 of the programmable hearing aid 4.

In step SP 132, the sound source file accessed earlier is reproduced at the sound source signal converting element 11*b* and the sound source presenting element 11*d* and presented to the programmable hearing aid 4 from the speaker 6. The user listens to the output sound (i.e. sound source which has been hearing aid-processed in response to the solution vector $p_k$) of the programmable hearing aid 4.

In step SP 133, the evaluation value acquiring element 22*d* acquires the value $E_k$ assigned by the user to the presented sound i.e., the solution vector $p_k$ at that time. The evaluation value $E_k$ is a numerical value expressing the user's subjective evaluation, based on comfort and intelligibility of the presented sound, wherein there are grades from 1 to 5, in which the grade 1 shows the lowest evaluation, while the grade 5 shows the highest evaluation.

When the user determines the evaluation value, he can refer to the shape of the frequency responses that are illustrated at the visual diagram presenting element 22*a*. For example, in FIG. 16, when the user evaluates an individual No. 8, the evaluation value can be finally determined confirming the evaluation he has given to an individual No. 2 of which the frequency responses are similar to those of the individual No. 8.

Also, even when the generation of the solution vector p k has evolved, both the current solution vector set and the frequency responses disappear from the screen, and a new solution vector set appears on the screen, a special feature of the solution vector $p_k$ that the user has evaluated in the preceding generation can be remembered based on the shape of the frequency responses. Thus, fluctuations in the evaluation can be minimized.

In step SP 134, if the user has requested renewal of the solution vector set, the program goes to step SP 135. If not, steps SP 129 to SP 134 are repeated.

In step SP 135, a judgment is made as to whether or not all of the evaluation values of $E_1$ to $E_{10}$ have been acquired and if not acquired, the program goes back to step SP 129, wherein the above-mentioned operations are repeated.

On the other hand, when all evaluation values of $E_1$ to $E_{10}$ have been acquired, in step SP 136, a judgment is made as to whether or not predetermined finishing conditions have been met.

In step SP 136, when a judgment is made that the predetermined conditions have been met, the fitting operation is completed. The solution vector $p_k$ which has acquired the highest evaluation value within the current solution vector $p_k$ (k=1, 2, 3. . . , m) is treated as a final fitting value.

"Predetermined finishing conditions" here mean those conditions for completing the evolution of the genetic algorithm (GA). For example, by determining the number of evolutions in advance, the fitting operation may be automatically completed when that number reaches a predetermined level. On the other hand, when a judgment is made that the finishing conditions have not been met, in step SP 137, selection, chiasma and mutation in the genetic algorithm (GA) are performed using the current solution vector set $p_k$ (k=1, 2, 3. . . , m) and the evaluation values $E_k$ for each solution vector $p_k$ so as to generate a new solution vector set $p'_k$.

The above-mentioned operations (SP 129 to SP 136) are repeated for the new solution vector set $p'_k$ (k=1, 2, 3. . . , m).

Although not particularly shown in FIG. 15, the acquisition of the evaluation value $E_k$ need not always be performed as soon as the sound source is presented. The previous evaluation value $E_k$ is often designed to be rewritable any time before the new solution vector $p'_k$ is generated.

Further, to avoid presentation of too large a sound or too small a sound, a range limit is provided for the adjustment value of each of the volume controller and the output limiter. However, the number of controllers for providing the range limit is not limited to these two units. The range limit may be provided on other controllers such as an AGC controller and a tone controller according to the purpose.

In addition, the limit range of search space for the solution vector $p_k$ is determined using the audiogram and a known fitting formula. However, by preparing a predetermined signal for inspection (such as a pure tone sound and a band noise) in the sound source memory element 11*a* in advance, the hearing threshold level (HTL) and/or the uncomfortable (loudness) level (UCL), the most comfortable (loudness) level (MCL) and the like of the user are found using that signal, wherein limits may be provided for the values of the controllers according to these values found.

The number of evolutions of the genetic algorithm (GA) is described as the finishing conditions. In addition, the fitting operation may be completed when the solution vector $p_k$ of $E_k$=5 exceeds the predetermined number or when the mean value of $E_k$ exceeds the predetermined value.

Also, by estimating a convergent condition of the genetic algorithm (GA) from the Euclidean distance between each solution vector $p_k$ and the like, the fitting operation may be completed when the convergent condition exceeds a fixed level.

The solution vector $p_k$ which has obtained the highest evaluation value in the current solution vector set $p_k$ (k=1, 2, 3. . . , m) is treated as the final fitting value, but it is considered that there may be a plurality of solution vectors $p_k$ with the most points (5 points). In such a case, any one of these may be selected at random as the final fitting value, or the user is asked again to listen to only the solution vector $p_k$ with the most points and select his preferred solution vector $p_k$.

In the embodiments of the present invention, the diagram presented from the visual diagram presenting element 22*a* is treated as the frequency responses generated by the solution vector $p_k$. However, the diagram in this case may not be the frequency responses, provided that the diagram is based on the acoustic information expressed by the solution vector $p_k$. For example, if the hearing aid is a type (the so-called AGC hearing aid or non-linear hearing aid) that can change the input/output functions of a sound, the input/output functions may be treated as the visual diagram.

Further, the diagram presented from the visual diagram presenting element 22*a* may be a time waveform of the hearing aid for an output sound when the specified sound signal is input to the hearing aid. The input sound in this case may use the sound source used in the genetic algorithm, or other sound signals.

The diagram presented by the visual diagram presenting element 22*a* may be a sound spectrogram of the hearing aid for an output sound when the specified sound signal is input to the hearing aid. The input sound in this case may use the sound source used in the genetic algorithm, or other sound signals.

In the embodiments of the present invention, only the hearing aid fitting operation is described, but application of the present system optimization adjusting method is not limited to the hearing aid fitting operation. This system optimization adjusting method may also be applied to the case where acoustic characteristics suited to the preferences of the user are produced, for example, in the audio equipment. In this case, the present system optimization adjusting method is performed using the values of a tone controller, a volume controller and the like in the audio equipment to be targeted, as the component of the solution vector.

What is claimed is:

1. An optimum solution method for a problem in hearing aid fitting processing that determines one optimum n-dimensional solution vector based on optimum n-dimensional solution vector candidates corresponding to a plurality of conditions, comprising:

a first step of illustrating positions of a plurality of optimum n-dimensional solution vector candidates for hearing aid fitting in a two-dimensional space;

a second step of selecting an optional coordinate in the two-dimensional space; and a third step of computing an n-dimensional solution vector corresponding to the optional coordinate selected based on the coordinates of the plurality of optimum n-dimensional solution vector candidates in the two-dimensional space;

wherein an optimum n-dimensional solution vector is determined based on the plurality of optimum n-dimensional solution vector candidates.

2. The optimum solution method according to claim 1, wherein the plurality of optimum n-dimensional solution vector candidates is found by an interactive genetic algorithm.

3. The optimum solution method according to claim 1 wherein the n-dimensional solution vector comprises adjustment parameters of a hearing aid.

4. The optimum solution method according to claim 1 wherein the n-dimensional solution vector comprises adjustment parameters of an image.

5. The optimum solution method according to claim 1 wherein the plurality of optimum n-dimensional solution vector candidates are optimum n-dimensional solution vectors for a plurality of sound sources.

6. The optimum solution method according to claim 1, wherein in said first step a user receives a visual image representation of the optimum n-dimensional solution vector candidates for hearing aid fitting in the two dimensional space, and in said second step the user's response as expressed in terms of a location on the visual image representation is the optional coordinate in the n-dimensional space.

7. The optimum solution method according to claim 1, wherein the n-dimensional solution vector candidates comprises adjustment parameters of a hearing aid, acoustic function diagrams and/or solution vector sets which are presented to a user in said first step as a visual image representation.

8. An optimum solution method for a problem in hearing aid fitting processing that allows a user to determine an optimum n-dimensional solution vector based on optimum n-dimensional solution vector candidates corresponding to a plurality of conditions, comprising:

a first step of illustrating positions of a plurality of optimum n-dimensional solution vector candidates for hearing aid fitting in a two-dimensional space;

a second step of allowing the user to select an optional coordinate in the two-dimensional space; and a third step of computing an n-dimensional solution vector corresponding to the optional coordinate that the user has selected, based on the coordinates of the plurality of optimum n-dimensional solution vector candidates in the two-dimensional space and an evaluation value by the user of the plurality of n-dimensional solution vectors which has been acquired in advance;

wherein the user can determine an optimum n-dimensional solution vector, based on the plurality of optimum n-dimensional solution vector candidates.

9. The optimum solution method according to claim 8, wherein the evaluation value assigned by the user to the plurality of n-dimensional solution vectors is acquired by an interactive genetic algorithm.

10. The optimum solution method according to claim 8, wherein in said first step the user receives a visual image representation of the optimum n-dimensional solution vector candidates for hearing aid fining in the two dimensional space, and in said second step the user's response as expressed in terms of a location on the visual image representation is the optional coordinate in the n-dimensional space.

11. The optimum solution method according to claim 8, wherein the n-dimensional solution vector candidates comprises adjustment parameters of a hearing aid, acoustic function diagrams and/or solution vector sets which are presented to the user in said first step as a visual image representation.

* * * * *

UNITED STATES PATENT AND TRADEMARK OFFICE

CERTIFICATE OF CORRECTION

PATENT NO. : 7,343,021 B2
APPLICATION NO. : 09/738388
DATED : March 11, 2008
INVENTOR(S) : Takagi et al.

It is certified that error appears in the above-identified patent and that said Letters Patent is hereby corrected as shown below:

Title page:

In section (56), "References Cited", further under "FOREIGN PATENT DOCUMENTS", after "9054765" delete the asterisk. (Applicant cited this reference by way of Information Disclosure Statement concurrent with the application filing on 15 December 2000; Examiner re-cited same reference on 04 February 2008 after Applicant requested the initialled Form PTO-1449 for the original citation, which the Patent Office lost).

Under "(57) ABSTRACT", 2nd line, change "method that determines" to --method, that determines an--.

4th line, change "candidates to an" to --candidates to--.

5th line, after "programmable hearing aid" insert a comma.

Column 1:

Line 35, change "acteristics and the like which" to --acteristics, and the like, which--.

Column 2:

Line 15, change "leaves an a-units" to --reproduces an a-unit--.

Line 16, change "as is" to --as-is--.

Line 29, change "Scaling) and the like based, on" to --Scaling), and the like, based on--.

Line 35, change "characteristic, and the like that" to --characteristic, and the like, that--.

Line 48, change "audiogram and the like in a" to --audiogram, and the like, in a--.

Line 66, change "formula and the like," to --formula, and the like,--.

Column 3:

Line 17, change "formula and the like," to --formula, and the like,--.

Line 50, change "before and as a" to --before and, as a--.

Column 4:

Line 17, change "In this embodiment" to --In one embodiment--.

Line 61, change "It is therefore possible" to --It is, therefore, possible--.

Column 5:

Line 43, change "information which are displayed" to --information which is displayed--.

UNITED STATES PATENT AND TRADEMARK OFFICE

CERTIFICATE OF CORRECTION

PATENT NO. : 7,343,021 B2
APPLICATION NO. : 09/738388
DATED : March 11, 2008
INVENTOR(S) : Takagi et al.

It is certified that error appears in the above-identified patent and that said Letters Patent is hereby corrected as shown below:

Column 6:
Line 24, lines 32-33, line 40, and lines 65-66, change "It is therefore possible" to --It is, therefore, possible--.

Column 7:
Lines 5-6, line 12, lines 18-19, and line 26 change "It is therefore possible" to --It is, therefore, possible--.

Column 9:
Line 10, change "fitting value, i.e. an" to --fitting value, i.e., an--.
Line 55, change "present embodiment" to --present invention--.
Line 65, change "meter and the like by" to --meter, and the like, by--.

Column 10:
Line 30, change "output sound (i.e. the" to --output sound (i.e., the--.
Line 35, change "sound, i.e. the solution" to --sound, i.e., the solution--.

Column 11:
Line 57, change "output sound (i.e. the" to --output sound (i.e., the--.

Column 12:
Line 14, change "and therefore further explanation" to --and, therefore, further explanation--.
Line 16, change "parameters (e.g. values" to --parameters (e.g., values--.
Line 19, change "diagram (e.g. frequency" to --diagram (e.g., frequency--.
Line 29, change "It is therefore possible" to --It is, therefore, possible--.
Line 55, change "and therefore further explanation" to --and, therefore, further explanation--.

Column 13:
Line 3, change "mapping technique and" to --mapping technique, and--.
Line 13, change "solution vector of which" to --solution vector, of which--.
Line 22, change "and therefore further explanation" to --and, therefore, further explanation--.
Line 47, change "not be formed (e.g." to --not be formed (e.g.,--.

Column 14:
Line 52, change "output sound (i.e. the" to --output sound (i.e., the--.

UNITED STATES PATENT AND TRADEMARK OFFICE

CERTIFICATE OF CORRECTION

PATENT NO. : 7,343,021 B2
APPLICATION NO. : 09/738388
DATED : March 11, 2008
INVENTOR(S) : Takagi et al.

It is certified that error appears in the above-identified patent and that said Letters Patent is hereby corrected as shown below:

Column 15:
Line 12, change "and therefore further explanation" to --and, therefore, further explanation--.
Line 14, change "parameter (e.g. values" to --parameter (e.g., values--.
Line 17, change "diagram (e.g. frequency" to --diagram (e.g., frequency--.
Line 28, change "It is therefore possible" to --It is, therefore, possible--.
Lines 52-53, change "and therefore further explanation" to --and, therefore, further explanation--.

Column 16:
Line 12, change "the solution vector distance" to --the solution vector candidate $P_h$ and the Euclidian distance--.
Line 51, change "or the like and" to --or the like, and--.
Line 52, change "goods and the like which" to --goods, and the like, which--.
Line 60, change "preferences of the use." to --preferences of the user.--.

Column 17:
Line 30, change "speaker 6 and the like." to --speaker 6, and the like.--.

Column 18:
Line 5, change "meter and the like," to --meter, and the like, --.
Line 18, change "number and the like" to --number, and the like,--.
Line 36, change "output sound (i.e. the" to --output sound (i.e., the--.
Line 42, change "sound, i.e. the solution" to --sound, i.e., the solution--.

Column 20:
Line 8, change "and the like of" to --and the like, of--.
Line 20, change "vector $p_k$ and the like and" to --vector $p_k$, and the like, and--.
Line 29, change "solution vector $p_k$ with the highest number of point to select" to --solution vectors $p_k$ with the highest number of points to select--.
Line 47, change "lens and the like and" to --lens, and the like, and--.
Line 48, change "goods and the like suited" to --goods, and the like, suited--.

Column 21:
Line 44, change "meter and the like," to --meter, and the like,--.
Line 58, change "number and the like," to --number, and the like,--.
Line 67, change "(tone controller" to --(tone controller,--.

UNITED STATES PATENT AND TRADEMARK OFFICE

CERTIFICATE OF CORRECTION

PATENT NO. : 7,343,021 B2
APPLICATION NO. : 09/738388
DATED : March 11, 2008
INVENTOR(S) : Takagi et al.

It is certified that error appears in the above-identified patent and that said Letters Patent is hereby corrected as shown below:

Column 22:
Line 33, change "output sound (i.e. sound" to --output sound (i.e., sound--.
Line 38, change "presented sound i.e., the" to --presented sound, i.e., the--.
Line 52, change "solution vector p k" to --solution vector $p_k$--.

Column 23:
Line 53, change "vector $p_k$ and" to --vector $p_k$, and--.

Column 24:
Line 29, change "controller and the like in" to --controller, and the like, in--.
Line 67, change "in the two dimensional" to --in the two-dimensional--.

Column 26:
Line 13, change "hearing aid fining in the two dimensional" to --hearing aid fitting in the two-dimensional--.

Signed and Sealed this

Seventh Day of April, 2009

JOHN DOLL
*Acting Director of the United States Patent and Trademark Office*